US009884671B2

(12) United States Patent
Ekhoff

(10) Patent No.: US 9,884,671 B2
(45) Date of Patent: Feb. 6, 2018

(54) MARINE PROPULSION SYSTEM AND METHOD

(76) Inventor: Donald L. Ekhoff, Post Falls, ID (US)

( * ) Notice: Subject to any disclaimer, the term of this patent is extended or adjusted under 35 U.S.C. 154(b) by 624 days.

(21) Appl. No.: 13/489,747

(22) Filed: Jun. 6, 2012

(65) Prior Publication Data

US 2012/0244760 A1 Sep. 27, 2012

Related U.S. Application Data

(63) Continuation-in-part of application No. 12/543,783, filed on Aug. 19, 2009, now abandoned.

(51) Int. Cl.
*B63H 1/04* (2006.01)
*B63H 5/02* (2006.01)

(52) U.S. Cl.
CPC ..... *B63H 1/04* (2013.01); *B63H 5/02* (2013.01); *Y10T 137/85978* (2015.04)

(58) Field of Classification Search
CPC ... B63H 1/00; B63H 1/02; B63H 1/04; B63H 1/06; B63H 1/08; B63H 1/10; B63H 1/30; B63H 1/32; B63H 1/34; B63H 1/38; B63H 5/00; B63H 5/02; B63H 5/03; B63H 5/04
USPC ..... 440/90–100; 416/131; 60/673
See application file for complete search history.

(56) References Cited

U.S. PATENT DOCUMENTS 1,527,571 A 2/1925 Morrison
2,941,494 A * 6/1960 McBride ..... 440/97
3,076,427 A * 2/1963 Stapleton ..... 440/43
3,251,334 A * 5/1966 Beardsley ..... 440/90
3,326,165 A * 6/1967 Collins ..... 114/278
3,759,213 A * 9/1973 Quady ..... 440/38
4,171,675 A 10/1979 Thompson
4,264,276 A 4/1981 Massey
4,339,923 A 7/1982 Hays et al.
4,832,642 A 5/1989 Thompson
5,667,415 A 9/1997 Arneson
6,814,636 B2 11/2004 Nolen
7,090,553 B1 8/2006 Seiford, Sr.
7,125,299 B1 10/2006 Ross, Jr.
(Continued)

OTHER PUBLICATIONS

Harte, et al., "An application of paddlewheel propulsion to a high speed craft", Second International Symposium on Marine Propulsors, Jun. 2011, 8 pages (pp. 1-8 in pdf), Hamburg, Germany.

*Primary Examiner* — Daniel V Venne
(74) *Attorney, Agent, or Firm* — Mitch Harris, Atty at Law, LLC; Andrew M. Harris

(57) ABSTRACT

A method for propulsion of a marine vessel, a liquid-directing system and a marine propulsion system are presented. Water-directing scoops are moved in a rearward direction while the scoops are dipping into the water. The scoops may be arranged about a hub. Water is scooped using a bottom edge and lower sides of each of the scoops. Each scoop has an open-faced concave interior and directs scooped water towards a centerline and towards a water exit region of the scoop. The water exit region remains above the local or apparent waterline while the water is scooped, directed and ejected. Water is ejected from the water exit region of the scoop in the rearward direction and at a relative exit velocity that is greater than a relative entrance velocity of water being scooped. Rearward ejection of the water expresses a forward thrust of the propulsion system. Other liquids may be used.

20 Claims, 16 Drawing Sheets

(56) References Cited

U.S. PATENT DOCUMENTS 7,445,530 B2 * 11/2008 Munshaur et al. ..... 440/12.66
7,448,930 B2 11/2008 Diggins

* cited by examiner

MARINE PROPULSION SYSTEM AND METHOD

CROSS-REFERENCE TO RELATED APPLICATION

This application is a continuation-in-part of U.S. non-provisional application Ser. No. 12/543,783, filed Aug. 19, 2009 and abandoned on Sep. 5, 2012.

TECHNICAL FIELD

The invention relates generally to powering a marine vessel and more particularly to a tangential rotary drive system for marine propulsion.

BACKGROUND ART

There is a wide variety of known techniques for propelling a marine vessel. Marine vessel herein is meant to refer to ships, boats, watercraft, and other vessels operating in fresh or saltwater, and is not restricted to ocean vessels. Manual techniques for propelling marine vessels include the use of oars, paddles, and poles. Sails also provide propulsion without the need of motors. However, motorized propulsion typically provides greater control and greater speed.

Motorized marine propulsion techniques include the use of paddle wheels, screw propellers, and water jets. Paddle wheels are uncommon except in nostalgic riverboats and lake paddle-steamers, e.g. stern-wheelers and side-wheelers, since conventional paddle wheels are bulky and tend to be inefficient. The paddle wheels are basically "pushers" in which flat paddle planks are rotated through water, thereby using the viscous flow resistance of the paddle to propel the marine vessel along the surface of the water. The inefficiency results from the insertion and extraction losses, as well as turbulence losses. In comparison, the screw propeller exhibits turbulence losses, but is somewhat more efficient because the propeller remains submerged. Water jets direct a high speed stream of water from a nozzle. While water jets provide advantages over other techniques, inefficiency results from the high levels of wetted surface and turbulence involved in moving an incompressible fluid through an often complex configuration at high velocity.

In general, water manipulation in propulsion systems for marine vessels is very lossy, especially when the water is tightly constrained and/or takes on a negative pressure equal to the vapor pressure of the water. This last effect is called cavitation and is very destructive. Propellers create huge turbulence as water is forced to flow around various surfaces, and vortexes abound. A propeller vortex is a spinning water column where the core is a vapor hole or vacuum. This takes a lot of energy to form as it contains huge viscosity losses. When the core collapse, it blows erosion pits into the steel hull and rudder assembly of the marine vessel, incurring extensive maintenance and repair costs. Ducted waterjet pumps are even more lossy, as they have all the pumping losses associated with the associated ducted enclosure and the viscosity of water. Water is difficult to duct at high velocity as it is non-compressible, dense and viscous.

While the known techniques operate well for their intended purposes, further advantages are sought. Such advances may be in one or more of a number of areas, such as efficiency, speed, safety, and adaptability.

SUMMARY

A method for propulsion of a marine vessel situated in water, a liquid-directing system and a marine propulsion system are herein presented. The method and systems rely on water-directing scoops. During operation, the scoops direct water to exit the scoops at high speed in a rearward direction. This action produces an equal and opposite reaction expressed as a forward thrust of the propulsion system, which can be applied to propel a marine vessel.

In the method, a marine vessel is situated in water. Each of a plurality of water-directing scoops is dipped into the water. The scoops have a concave interior. Each of the scoops is moved in a rearward direction relative to the marine vessel while the scoop is dipping into the water. When a given scoop is at a mid-scooping position, the given scoop is positioned with respect to the apparent waterline such that less than half of the concave interior of the given scoop extends below the apparent water line. The scooped water is concentrated towards a centerline and a water exit region of each of the scoops. Each of the scoops then ejects the water from the water exit region of the scoop in an accelerated jet of water that is directed fully rearward or downward. The directed scooped water is ejected from the water exit region of the scoop at a scoop-relative exit velocity that is greater than a scoop-relative entrance velocity at which the water ejected in the accelerated jet of water entered the given scoop. Thereby, a forward thrust is produced on the marine vessel. The water exit region of the scoop remains above a local. waterline or an apparent waterline while the water is scooped, directed and ejected.

The marine propulsion system includes a rotatable hub and a plurality of water-directing scoops. The scoops are arranged about the hub and connected to the hub, for example rigidly or by a continuous track. Each scoop has a smoothly rounded concave interior. The concave interior is open-faced in a rearward direction when expressing a forward thrust of the propulsion system. Each scoop has a bottom edge distal to the hub. Each scoop has an exit-directing region that is a portion of the concave interior and is proximate to a top edge of the scoop. The exit-directing region is distal to the bottom edge of the scoop. The exit-directing region is approximately parallel to an instantaneous direction of travel of the scoop.

DETAILED DESCRIPTION

Figure 1:
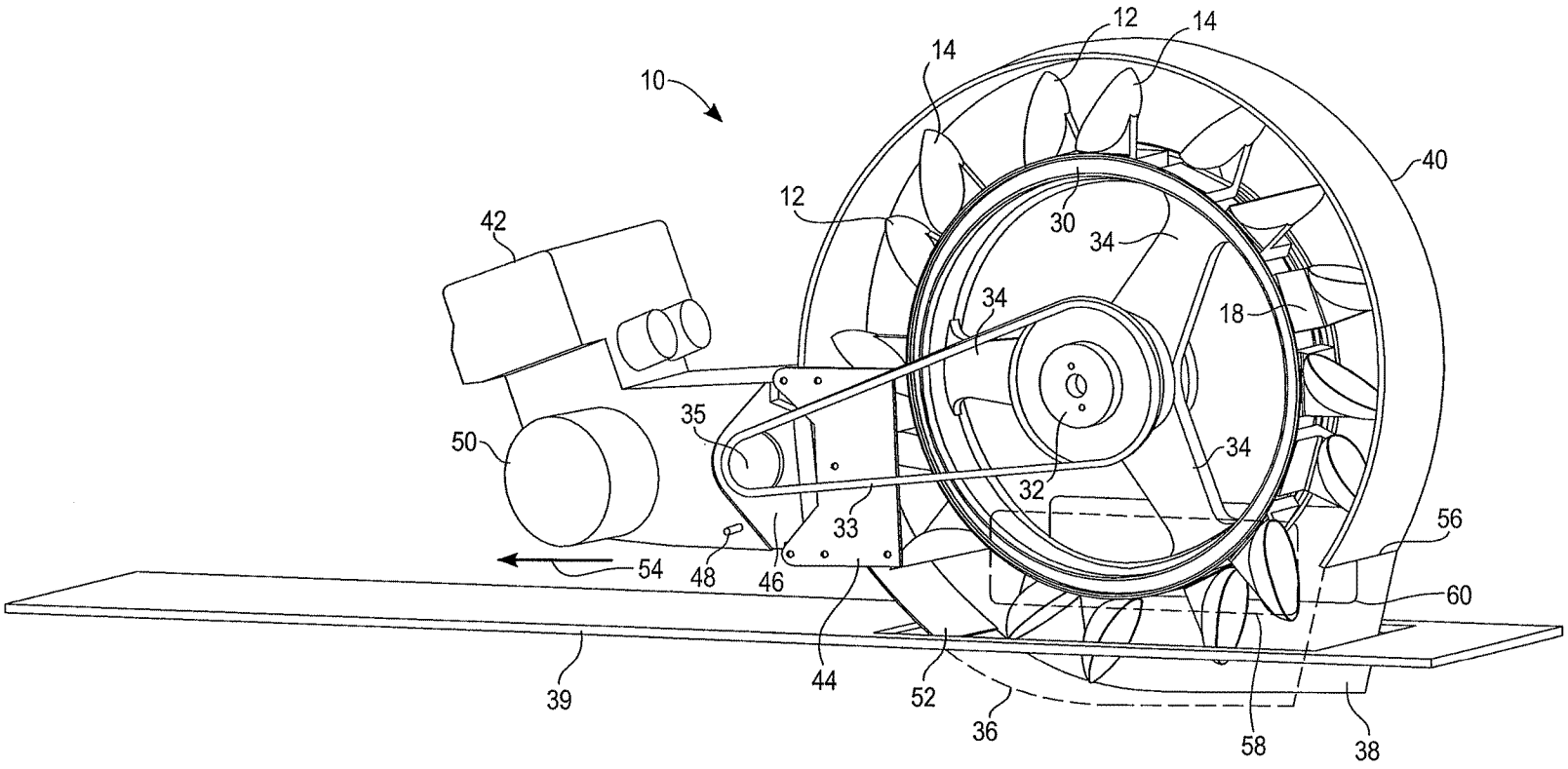
FIG. 1 is a perspective view of one embodiment of a marine propulsion system in accordance with the invention.

FIGS. 1-10 show embodiments of a marine propulsion system and related method in accordance with the present invention, based on improvements to the well-known paddle wheel and paddlewheel-powered boats. Analysis of conventional paddles and blades is shown in FIGS. 11-19. This analysis is followed and contrasted by analysis of an embodiment of a scoop on a propulsion wheel in the marine propulsion system, shown in FIGS. 20-29. A further embodiment of a forked scoop is presented in FIG. 32. An actual reduction to practice is depicted in FIG. 33 and a further reduction to practice is depicted in FIGS. 34-37. Further embodiments are shown in FIGS. 38-48. Although embodiments are shown and described as relating to water, it is understood that other liquids could be used. For example, one embodiment is a liquid-directing system. Water is a liquid to which the liquid-directing system can be applied.

The present improvements include replacing the rectangular board-shaped paddles of known paddle wheels, or other known paddles or blades, using in their place water-channeling or water-directing members or scoops shaped to scoop water and eject the water at high relative speed. By scooping the water and directing the water to exit the scoop as a high-speed jet of ejected water, the scoops greatly decrease losses from water turbulence and cavitation and are thus much more efficient for propulsion of a marine vessel than the rectangular board-shaped paddles of known paddle wheels. The scoops greatly increase the reaction force used to propel a marine vessel, as compared to throwing water off of a known paddle wheel at approximately the tangential velocity of the paddle, i.e. at approximately a zero velocity relative to the paddle. The present marine propulsion system is a surface drive system, in that the water channeling, water-directing members or scoops partially enter and fully exit the water in each cycle about the hub.

In the marine propulsion system, a rotary driven propulsion wheel has an arrangement of water-channeling members with cavities that are configured to first concentrate incoming water and then eject the water as an accelerated flow. The mounting and the driving of the propulsion wheel are such that each water-channeling member periodically extends only partially into the water in which the marine vessel resides. As a particular water-channeling member is partially extended into water, a quantity of water is "scooped" within the cavity of the member. Inclined surfaces of the cavity cause the scooped water to be channeled from the submerged portion upwards toward a central region of the cavity. The water continues to follow the contour of the cavity surfaces and is ejected in a rearward direction as an accelerated jet of water.

In one embodiment, the cavity surface of each water-channeling member terminates in a curved end. The design of the curved end determines the direction of the water jet ejected from the member. While geometries of the system components will vary with the needs for a particular application, it is likely that the ejected water from a curved end will be a water jet with a velocity much greater than the velocity of the water-channeling member. Thus, the curved end is preferably directed such that the water jet exits the water-channeling member or scoop roughly parallel to the surface of the water and avoids contact with the other water-channeling members of the propulsion wheel, thereby avoiding efficiency losses.

The water-channeling members may be connected to the propulsion wheel along its exterior surface or may be integrated to the propulsion wheel during manufacture. Rather than having a planar region to contact the water as in the conventional paddle wheel, each water-channeling member may be described as having a cup-shape or a spoon-shape, although more complex shapes have advantages. Regardless of the particular shape of each member, water is gathered under the influences of inertial forces, consolidated into a high speed jet, and then ejected rearward relative to a forward direction of the vessel being driven.

The curved upper end of each water-channeling member can be configured to define thrust characteristics. For example, the mounting of the water-channeling members and the geometry of the curved upper ends may be designed to define a direction of propulsion that is nominally parallel to the water level surrounding the marine vessel. Alternatively, the curved upper end of the scoop or water-channeling member may have a termination at a downward angle toward the water level, such that a component of lifting force is applied in addition to the lateral, forward propulsion. This lifting force may be used to reduce friction as the marine vessel is moved along the surface of the water. In addition, the water-channeling members may be designed to create a high pressure area that has a tendency to lift the vessel by inciting hydraulic pressures acting directly on the water-channeling members. Other embodiments may have more of a lip which will cup water into the cavity to increase thrust while decreasing lift.

If the water-channeling members are too closely spaced along the propulsion wheel, water projected from one member may strike the reverse side of the subsequent member, regardless of the design of the curved upper end. If a greater amount of thrust is desired, the water-channeling members may be arranged in multiple axially separated rows, with each row having a number of aligned members. Additionally, the members of adjacent rows may be axially misaligned, such that the members of the adjacent rows are staggered.

This technology is similar to the turbine concept used in generating hydropower. While other differences exist, the most significant difference between the embodiments of the propulsion wheel shown herein and the power-generating systems (for example, the Pelton wheel and the Turgo turbine) is that the propulsion wheel is powered through water, rather than being powered by water.

Performance can be improved by including a hull or similar structure positioned forwardly of the propulsion wheel to precondition the water level. For example, the mounting of the propulsion wheel may include a hull or a portion thereof. During rotation of the propulsion wheel, the end regions of the water-channeling members pass from above the bottom of the hull to below the bottom of the hull and contact water. The rotational axis of the propulsion wheel is at a distance from the bottom of the hull to limit immersion of the water-channeling members as described above. Using the hull, the water level surrounding the marine vessel is consistently higher than the "apparent" level of water contacted by the members. This is because the hull "conditions" the surface of the water contacted by the members.

An advantage of the present marine propulsion system is that a greater efficiency is possible, as compared to conventional propeller-drive and jet-drive systems for marine vessels, because cavitation losses and large surface frictional pumping losses are significantly reduced or even eliminated. Another advantage is that maintenance and service requirements are reduced, since under normal circumstances only a small portion of the moving components of the propulsion system extend to the water and the large portion is easily accessible.

The propulsion system functions as a gyro stabilizer for the marine vessel. Where the propulsion wheel spins on a horizontal axis at high speed and with a considerable diameter and mass, the propulsion wheel will resist vessel rotations about its rotational axis and a vertical axis. This is most desirable when the vessel is at speed in rough water. It is further contemplated that this effect may be applied when propulsion of the vessel is not desired. The propulsion wheel can be raised sufficiently to spin freely without contact with water. Sea sickness is a result of the undulating "figure eight" motion that is unfamiliar to land passengers. The propulsion wheel may be used to reduce vessel motion to a much simpler rocking of the vessel about a port/starboard axis, thereby reducing common side-to-side rocking motion. It is possible to place an additional gyro-wheel within the propulsion wheel, so that this advantage is available irrespective of propulsion speed. In military applications, this effect may be used to stabilize a platform from which munitions are aimed.

With reference to FIG. 1, a propulsion system 10 in one embodiment includes two rows of water-channeling members 12 and 14 connected to a propulsion wheel 30. The water-channeling members 12 are in a row that is axially separate from the water-channeling members 14 of the other row. The members 12 and 14 are "water-channeling," since they are configured to collect water and channel the collected water so as to provide a thrust having desired characteristics. This embodiment shows the water-channeling members 12, 14 in staggered formation arrayed radially about the hub or rotating central assembly 32. Further embodiments have water-channeling members in three or more rows in staggered or non-staggered formation arrayed about a hub, in two or more rows in non-staggered radial formation arrayed about a hub, in a single row in radial formation arrayed about a hub, or in other arrangements about a hub. In FIG. 1, the members have a cup-shape, but other configurations are within the scope of the embodiments, including spoon-shaped members and those with a more complex geometry (for example, those which will be described with reference to FIGS. 8 and 9). Multiple rows of smaller water-channeling members can be used in place of fewer rows or one row of larger water-channeling members, and vice versa, as an optimum size of water-channeling member is sought for a specified diameter of propulsion wheel.

The mounting of the water-channeling members 12 and 14 to the propulsion wheel 30 may be accomplished using techniques known in the art. In FIG. 1, each member is connected to a respective plate 18 which is mounted to the propulsion wheel by fastening hardware, such as screws or bolts, or welded thereto. Alternatively, the water-channeling members may be integrally formed with the propulsion wheel during a manufacturing process. The structure of the illustrated propulsion wheel is similar to that of a wheel of a land vessel.

In a typical embodiment, a motorized rotary drive is coupled to operate the propulsion wheel 30. However, the propulsion system may be manually driven, such as by coupling the propulsion wheel to rotate as a person operates hand or foot pedals. Thus, the rotary drive may include a motor engine or may be an assembly similar to that of a bicycle.

In the embodiment of FIG. 1, the rim of the propulsion wheel 30 is connected to a hub or rotating central assembly 32 by three spokes 34. A belt 33 or chain couples the central assembly 32 to a drive gear 35. A representation of a motor 50 is included for reasons of explanation, but the rotary drive motor may vary significantly for alternative packaging requirements. Mounting plates 44 may be used to attach a pair of side walls 36 and 38 to a pivot plate 46 that attaches to a stationary portion 42. A restriction pin 48 may be included to set a limit as to the lower range of motion of the pivot plate. While not shown, a second restriction pin may be used to similarly limit the upper range of motion.

The side walls 36 and 38 are on opposite sides of the propulsion wheel 30. The side walls 36 and 38 combine with a shroud 40 to cover the water-channeling members 12 and 14, other than at a lower end of the propulsion system. In the illustration of FIG. 1, the nearer side wall 36 is shown in phantom, so as to allow the internal components to be viewed. The side walls 36 and 38 fend off large objects like logs and animals, yet complement the functionality of the propulsion wheel by restricting side splash. In embodiments, the side walls 36 and 38 are integrated with the hull, are separate fins, or are retractable.

Figure 2:
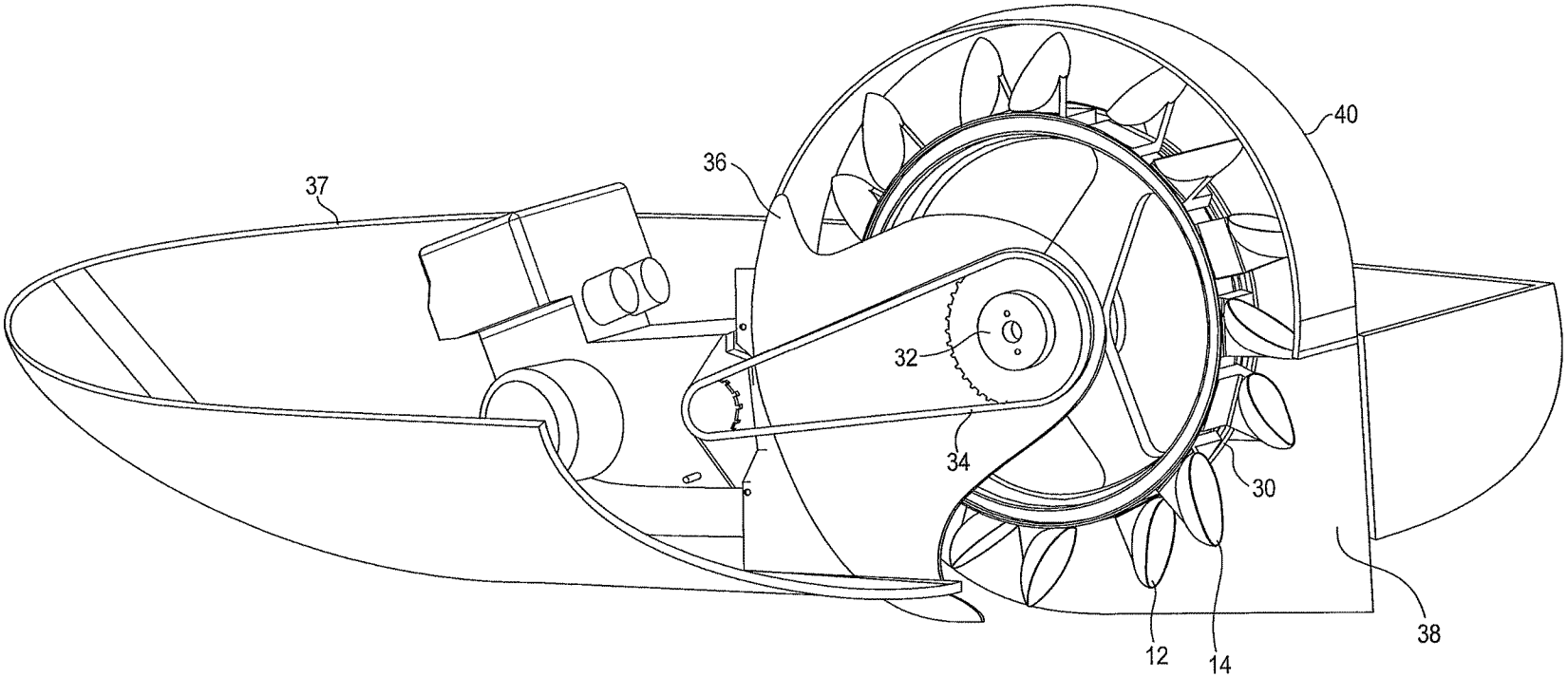
FIG. 2 is a perspective view of the propulsion system of FIG. 1 within a hull.

In operation, only the lowermost portion of the propulsion system 10 should reside below the system's "apparent water level." Referring to FIGS. 1-3, this apparent water level or apparent waterline is below the level of the water in which the marine vessel resides, which is called the local waterline. A hull 37 may be used to condition or adjust the water level as presented to the scoops or water-channeling members so as to define the apparent water level when the vessel is at speed. Only the bottom 39 of the hull is illustrated in FIG. 1, so that it may be seen that the shroud 40 has a termination 52 that is generally along the same horizontal plane with the hull bottom. This allows water to enter the region that is between the two sidewalls 36 and 38 and below the hull. In this embodiment, the hull or a portion thereof acts as a local waterline-adjusting device. Other types of local waterline-adjusting devices include plates or tunnels, which can be integrated with a portion of the hull of a marine vessel. A planing hull can allow the marine vessel to climb "up on the step" and adjust the apparent waterline. The bottom 39 of the hull, or a portion thereof, can form a plate that adjusts the apparent waterline when the marine vessel is at speed. The apparent water level can be appreciably below the local waterline, and can be regulated by the local waterline-adjusting device so as to present a lesser variation of water level to the water-channeling members than is the case with ripples and waves at the local waterline. A tunnel that adjusts the apparent waterline will be discussed with reference to FIG. 6. In further embodiments employed with other liquids besides water, an apparent liquidline is below the local liquidline.

Figure 3:
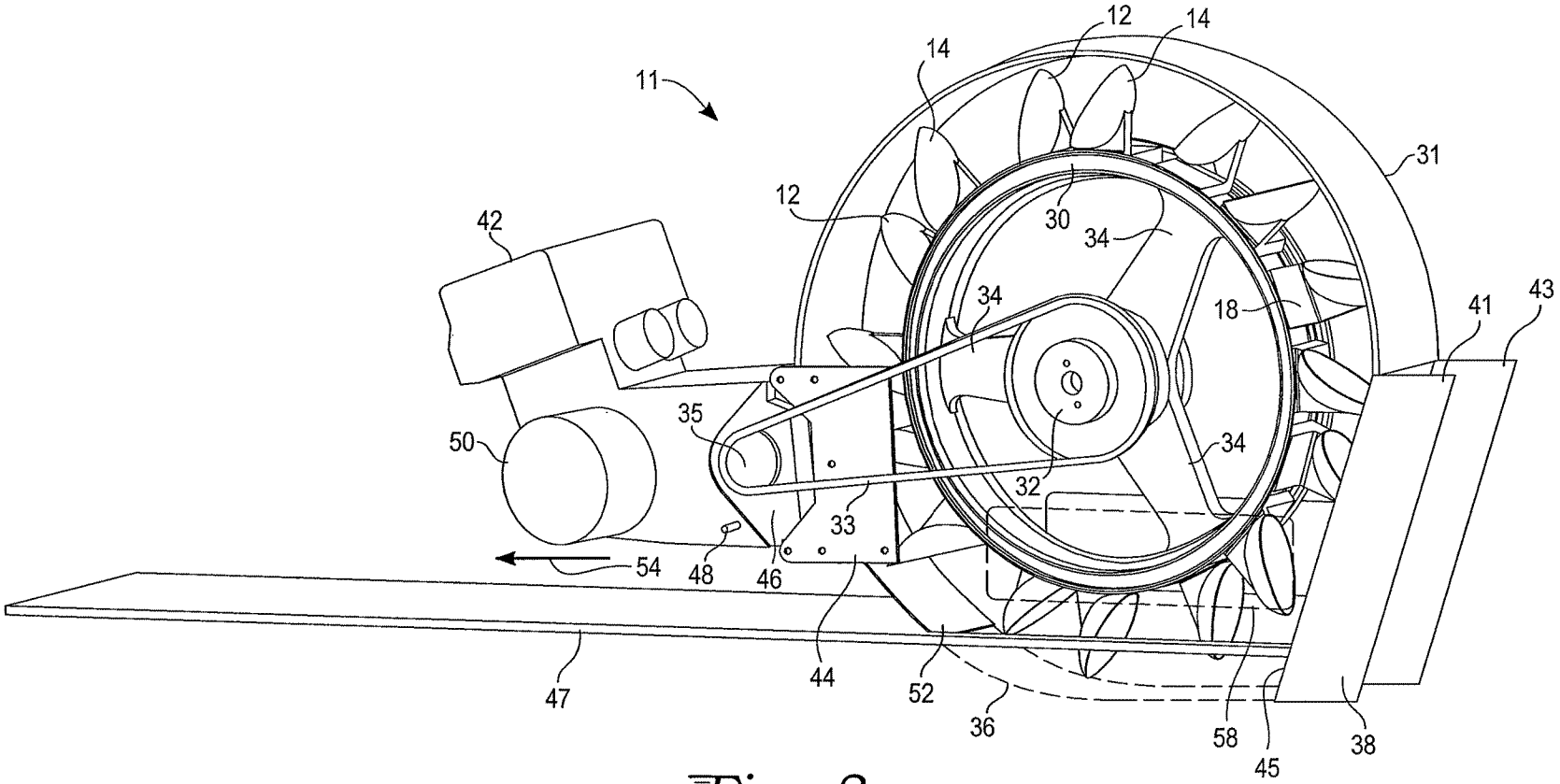
FIG. 3 is a perspective view of a further embodiment of the propulsion system of FIGS. 1 and 2.

With reference to FIG. 3, a further embodiment is shown as the propulsion system 11. In this embodiment, the bottom 47 of the hull joins directly with the shroud 31, eliminating an aperture in the hull 39 of the propulsion system 10 FIG. 1. The shroud 31 has a raised trailing edge as compared to the shroud 40, allowing for a greater vertical range of angles of water ejection by the water-channeling members 12 and 14. Twin rudders 41, 43 each have a respective hinge 45 along a leading edge of the rudder. The respective hinges 45 join the rudders 41, 43 to the side walls 36 and 38. The rudders 41, 43 extend downward into the water in which the marine vessel resides, allowing steering. The rudders 41, 43 can be used to deflect the water ejection flow from the water-channeling members 12 and 14, providing a further steering mechanism. Control mechanisms (not shown) for moving the rudders are readily devised.

Figure 4:
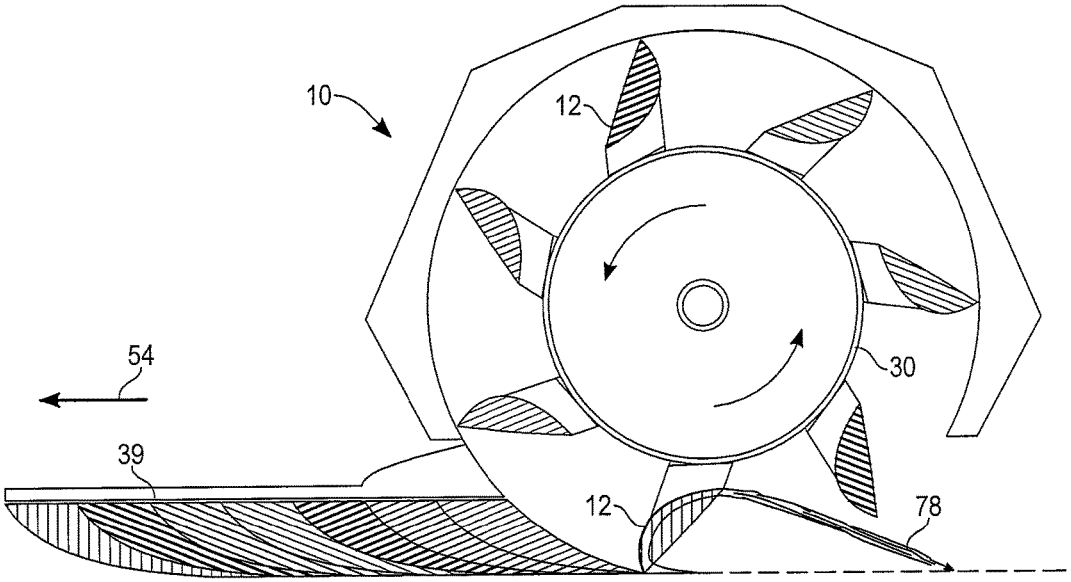
FIG. 4 is a schematic view of the propulsion system of FIG. 1 in an operational mode.

FIG. 4 represents the operation of the propulsion system 10, but only one row of water-channeling members 12 is shown. Briefly stated, each water-channeling member 12 is rotated into the surface of the water, thereby collecting and accelerating the water in conformance with the face of the member. Each water-channeling member is contoured to include side features which constrain and direct the water towards the centerline of the water-channeling member, thereby placing compressive or directive forces into the water stream. These compressive forces act to accelerate the flow of the water stream, causing the rearward ejected water stream to provide useful forward thrust (arrow 54 represents the forward direction). As water is to first approximation an incompressible fluid, compressive forces herein means forces directed to squeeze or narrow the entering flow of water being scooped. The squeezed water flow then narrows to a smaller cross-section at a higher velocity, and exits the water-channeling member 12 at high relative speed.

The water-channeling member may be limited to an immersion of approximately one-third of its length. That is, for purposes of propulsion, the member is only approximately one-third engaged relative to the original undisturbed surface of the water. Water is gathered under the influences of inertial forces, is consolidated into a high speed jet 78, and is ejected rearward. The jet ejection event is a direct function of the rotational location of the water ingestion or entry to the water-channeling member, i.e. the water being scooped. Once the water is ingested or scooped in by the water-channeling member, the water follows the contour of the cavity in the face of the member while it consolidates, narrows and accelerates into the jet of water expressed at the exit of the water-channeling member. The direction of this jet from the curved end of the member is a function of the placement of the water intake plus a few degrees of rotation of the hub, which is due to the time required for the scooped or ingested water to travel along the contour of the cavity of the water-channeling member. Each water-channeling member 12 takes a "bite" of the water as the member scoops into the water. The successive bites (or scoops) are represented by different crosshatchings of the "bites," which match the different hatchings of the water-channeling members. At rest, water will rise into the "hole" or "trench" being formed by the "digging" of consecutive scoops, but as speed increases, water is additionally made available towards the forward edge of the rotating propulsion wheel, due to the advancement of the marine vessel through the body of water. Slower and/or heavier vessels may make use of the additional water supplied by the water filling in the hole or trench, and have propulsion wheels with numbers or dimensions of water-channeling members adjusted accordingly. Faster and/or lighter vessels may make use of propulsion wheels designed with numbers or dimensions of water-channeling members adjusted to take into account the advancement of the marine vessel through the body of water.

As the propulsion system 10 drives the marine vessel forward, the hull 39 functions to condition the water for smooth successive "bites" by the newly arriving rotating water-bearing members 12. The efficiency of the system is increased if the propulsion wheel 30 and the members 12 are enclosed within the fairing (the side walls 36 and 38 and the shroud 40 that is shown in FIGS. 1 and 3). One reason is that the members 12 should not be overfilled. A general rule of thumb is that a member should take a "bite" which is approximately one third of its total capacity to hold water. "Overfilling" may result in the less efficient performance that is typical of a conventional paddle wheel, wherein the only reaction is from pushing on the water, rather than a combination of pushing on the water and "jetting" the channeled water. The hull is designed to reduce the likelihood that overfilling will occur. Moreover, by enclosing the rotating components, aerodynamic drag is reduced. The top of the propulsion wheel is moving at approximately twice the speed of the marine vessel and the added impulse speed of the members 12 would create considerable drag if the components were exposed. In addition to reducing drag, the fairing reduces noise, reduces spray, and increases safety.

An advantage of the propulsion system is that the propulsion wheel induces little turbulence. Water is directed in a laminar flow. This laminar flow is preserved throughout the scooping, directing and ejecting of the water in the water jet. Additionally, the "wetted area" is very small, since only the concave, rearward facing open face of a water-channeling member receives water and since only a portion of the member is immersed. This provides a control over surface friction losses. The convex, forward facing backside of the water-channeling member is spared contact to water as the scooped volume of water is replaced i.e. backfilled by air when the scooping action of the water-channeling member digs a high-speed trench in the water. Thus, the forward facing backside of the water-channeling member does not experience cavitation in the water. By contrast, a conventional propeller blade is fully immersed and subject to high surface frictional losses when translating through the water. High-speed conventional propeller blades experience cavitation in the water. Both of these types of losses and problems are greatly reduced or eliminated by the design and operation of the water-channeling member.

Figure 5:
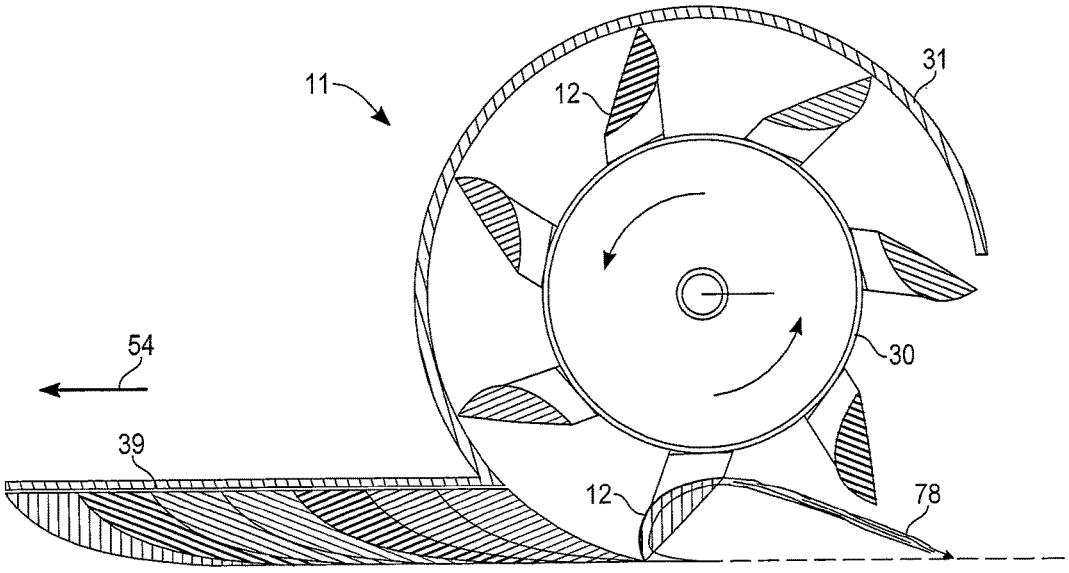
FIG. 5 is a schematic view of a further embodiment of the propulsion system of FIG. 1 in an operational mode.

FIG. 5 shows the propulsion system 11, including the shroud 31. Water thrown off of the water-channeling members 12 at higher speeds and greater loft can exit the system without impacting on the shroud 31.

Figure 6:
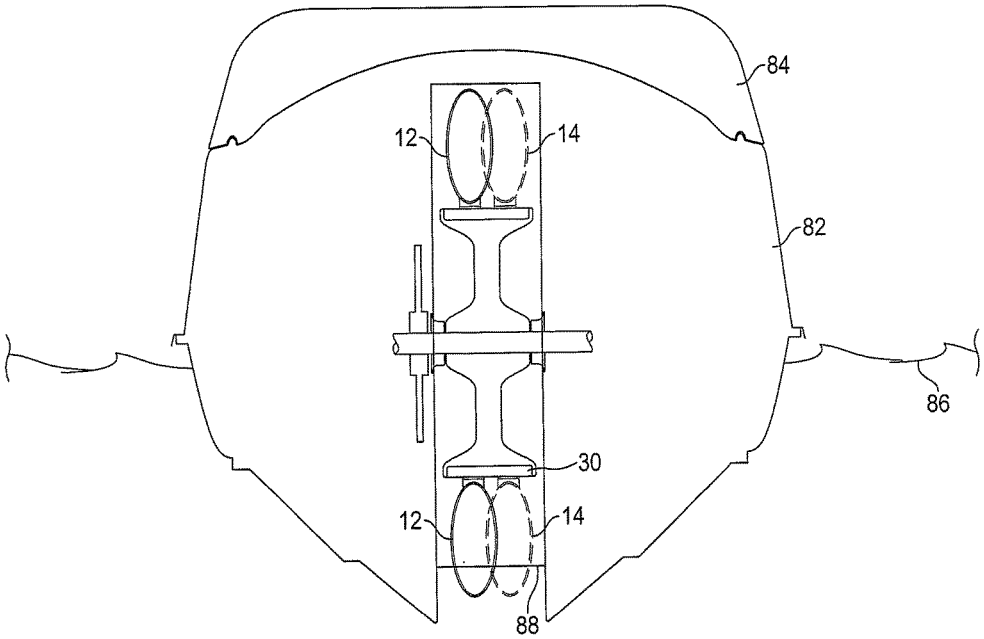
FIG. 6 is an end view of the propulsion system of FIG. 1 as used within a tunnel hull.

FIG. 6 is an end view of a tunnel hull 82 as used with a personal watercraft. A seat portion 84 is attached atop the hull portion. Because of the design of the tunnel hull, the water level 86 of the marine vessel is well above the water level 88 presented to the water-channeling members 12 and 14. As water flows relative to the vessel, each water-channeling member scoops a "bite" of water, compresses the water toward the central region of the cavity of the rearward face, and ejects the accelerated water rearward.

The tunnel hull of FIG. 6 provides advantages with respect to safety and to protection of the system. As can be seen, the marine vessel can pass over a person without a high risk of the rotating members 12 and 14 injuring the person. Similarly, if the hull passes over a log or other object, the members 12 and 14 are not likely to be damaged. In this embodiment, the tunnel hull 82 includes a deep "V" hull with a relatively narrow tunnel. Further embodiments include wider tunnels and deeper or shallower "V" hulls.

Figure 7:
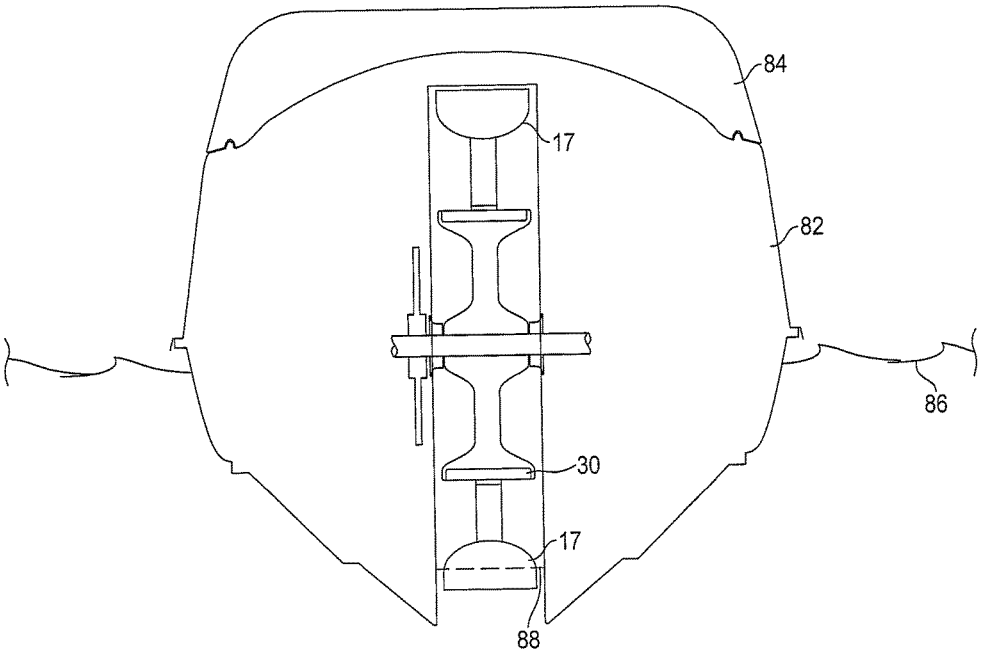
FIG. 7 is an end view of a further embodiment of the propulsion system of FIG. 1 as used within a tunnel hull.

FIG. 7 shows a further embodiment of the propulsion system, in the tunnel hull 82 as used with a personal watercraft. In this embodiment, an array of single scoops 17 is used as the arrangement of water-channeling members.

Figure 8:
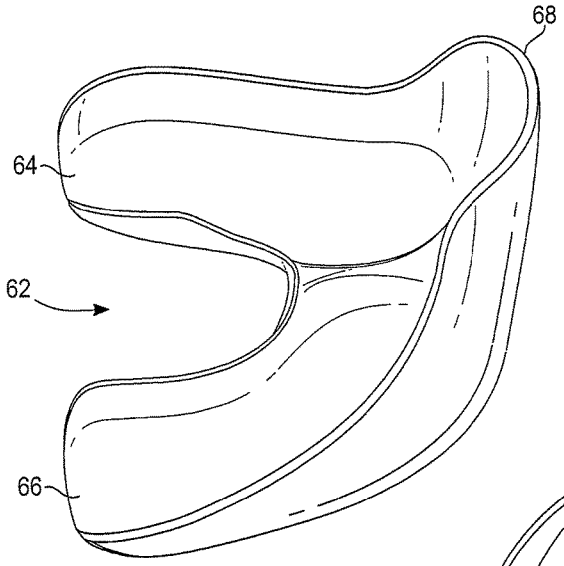
FIG. 8 is a perspective view of an alternative embodiment of a water-channeling member suitable for use in an embodiment of the propulsion system of FIG. 1.

FIG. 8 illustrates an alternative configuration for the water-channeling members. In this embodiment, each fork-shaped member 62 comprises a pair of fork tines or fingers 64 and 66, the tips of which form a truncated bottom edge distal to the hub to which the water-channeling members are affixed. When the water-channeling member is connected to a propulsion wheel and is allowed to extend into water such that only the ends of the fingers are submerged, water will be received and channeled upwardly. A curved end 68 narrows the flow of scooped water thus increasing the velocity of the water. The curved end 68 has a configuration that will at least partially determine the thrust characteristics of the individual member. The overall configuration of the member determines the increase in velocity of water, while the configuration of the curved end will play a role in the direction of applied force. The angle at which the individual member is mounted to the propulsion wheel will determine the "attack angle" of the fork tines or fingers 64 and 66 and will determine an angle at which water is projected from the curved end 68.

Figure 9:
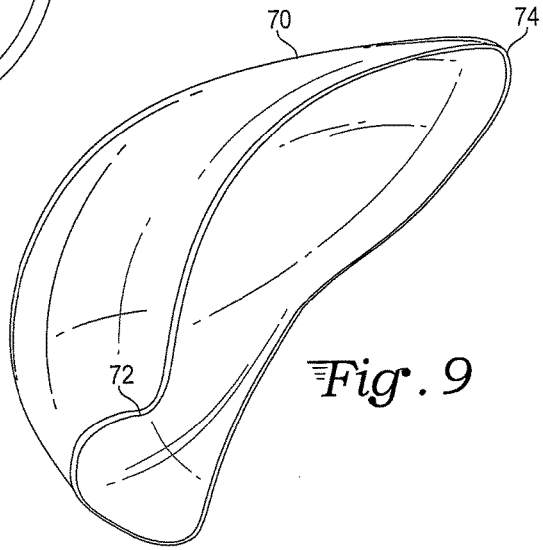
FIG. 9 is a perspective view of another embodiment of a water-channeling member suitable for use in an embodiment of the propulsion system of FIG. 1.

FIG. 9 is another embodiment of a water-channeling member. In this embodiment, the member 70 has a blunted, truncated water pick up end 72. A greater volume of water is able to be collected. However, as with the other embodiments, there is a region in which the ingested, scooped water flow will narrow and accelerate, so that water is increased in velocity and is projected from a curved end 74 having a configuration designed to achieve desired thrust characteristics.

Figure 10:
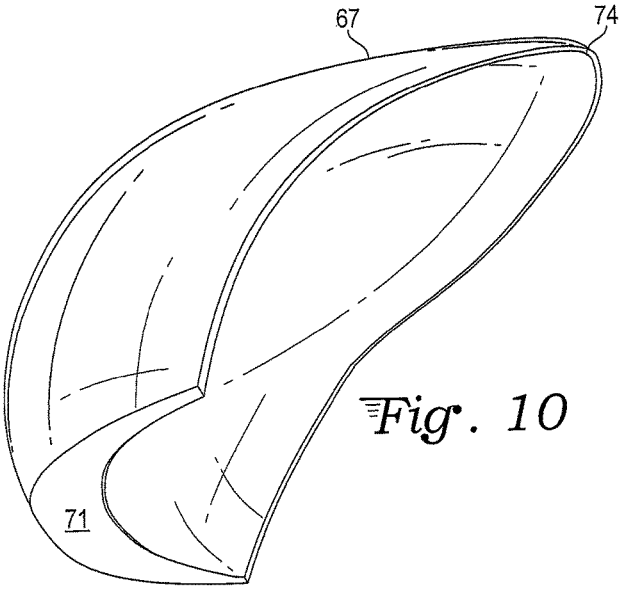
FIG. 10 is a perspective view of a further embodiment of the water-channeling member of FIG. 9.

FIG. 10 shows a water-channeling member 67 with a web 71 or floor. The web 71 is at the lower or bottom end of the water-channeling member 67, and serves to prevent water being scooped from spilling out past the lower or bottom end of the water-channeling member 67. In this embodiment, the web 71 has an inwardly curving leading edge. Further embodiments have a straight leading edge or an outwardly curving leading edge.

Referring again to FIG. 4, the water-channeling members 12 can be shaped and oriented to produce desirable characteristics. Nominally, the reaction jet 78 may be directed fully rearward for a maximum thrust. However, aiming the jet downwardly will produce lift, which may be used to provide levitation of the marine vessel so as to reduce friction.

There are a number of different possible lifting forces. As speed increases, there is a significant lifting force developed as water flows upwardly and encounters the compound curved end that forms the exit jet 78. This forces the water-channeling member 12 both forward and upward. The upward force helps support the weight of the marine vessel. If the members 12 are properly angled and sufficient speed is generated, there may be conditions in which the vessel is fully supported, altogether eliminating hull contact with the water and therefore eliminating drag which would otherwise result from viscous shear of the hull against the surface of the water. At this point, aerodynamic drag and gravitational forces would be in equilibrium with the forces generated by the propulsion system, and normal aquatic speed restrictions would be substantially reduced. Using a suspension system in combination with providing levitation results in a smoother and more efficient ride.

The propulsion system 10 may be connected to the marine vessel using a suspension system related to suspension systems of land vehicles. The mount which secures the propulsion wheel to the marine vessel may be configured to provide additional advantages. The mount may be enabled to move in a direction perpendicular to the water surface, thereby allowing the propulsion wheel to adapt dynamically. For example, articulating legs may be used in a manner similar to suspension systems for land vehicles. In one embodiment using a suspension system similar to that of an automobile, four shock absorbers are used, each with a respective coil spring or leaf spring. The shock absorbers and springs are mounted to the hull of the marine vessel and to the mounting for the propulsion wheel. A motor driving the propulsion wheel could be mounted either to the hull or to the mounting for the propulsion wheel. In a further embodiment using a suspension similar to that of a motorcycle, a shock absorber with respective spring is connected to the hull and to a pivoting swingarm or pivoting plate e.g. the pivot plate 46 attached to the stationary portion 42 of FIG. 1. The hub of the propulsion wheel is then mounted to the swingarm or pivoting plate 46. Two or more shock absorbers and respective springs can be applied to more rugged or heavy installations. Then, the propulsion wheel is free to rise or lower relative to the marine vessel. This permits a smoother passage of the marine vessel than would be achieved if the propulsion wheel were rigidly mounted to the vessel. Using such a suspension system or other means of absorbing path disruption in a controlled manner is most important for Ultra high Speed designs that may use the propulsion system.

In some applications, the fairing or hull for the propulsion system is part of the marine vessel itself, as is the case in the embodiment of FIG. 6. However, in other applications, the hull can provide floatation as well as desired stationary stability. It is possible to connect the propulsion system in a hollow watertight hull that is attached to the marine vessel using a suspension system that enables movement relative to the marine vessel, as discussed above. That is, the hull is able to adjust with waves and other changes in the water level of the main body of water. For example, where two propulsion systems are used to power a boat, two hulls may be connected to the boat in an "outrigger" manner. In many applications of the propulsion system, the suspension should be at the very front of the marine vessel, so as to help support the bow from clipping into the water trough, only to nose into the next wave crest. If propulsion pads are used to follow these undulations while tractoring up and down the wave faces, a much more consistent motive force can be obtained.

In the interest of further improving upon efficiency and performance, the hull is utilized as a platform upon which reaction thrust is applied. Conceptually, the moving components operate by transforming a section of scooped water into a much smaller cross section flow or "jet" of high speed water. The cross-section flow ratio may be roughly 3:1, but other ratios can be used, such as 1:1, 2:1, 4:1, 5:1 and greater. When a water-channeling member scoops water at a scoop-relative entry velocity of "x" and narrows the cross-section of the water flow by a factor of 3:1, the water is ejected at approximately a scoop-relative velocity of 3x and a waterline-relative velocity of 3x+x=4x. This results in a reaction thrust being applied to the propulsion wheel 30 and, therefore, the hull. By Newton's laws of motion, this reaction thrust applied to the marine vessel is equal in magnitude and opposite in direction to the force applied by the water-channeling member to the water. Thus, the water-channeling member pushes in a rearward direction on the water and directs the water out as a high-speed jet in the rearward direction, which action then creates an equal and opposite reaction and applies a force of equal magnitude in a forward direction on the propulsion wheel, hub and hull of the marine vessel.

Any viscous flow losses at the face of the water-channeling member are exhibited on the propulsion wheel and consequently the hull. The only undesirable losses acting on the system are aerodynamic losses on the propulsion wheel at the top side of its rotary motion. For this reason, the propulsion wheel is enclosed within the shroud.

Because the propulsion wheel acts like a centrifugal air pump, there is a low pressure area at the center where engine exhaust or ventilation can be supplied as a free benefit. This ventilation can be applied to the bilge region to decrease the possibility of bilge explosions, which are a safety risk in ships.

From the foregoing, it is apparent that the propulsion system operates on inertial mechanisms in which water is in contact with a "cupped" member only on its compression side. The system "slings" water at accelerated speeds as an efficient reaction jet mechanism with minimal lossy contact with the water being ejected. Convention paddle boats work primarily on viscous drag principles, while propellers work on lifting body (wing) principles. Water jets work primarily on pumping/ejection principles. The present propulsion system controls losses associated with all of these mechanisms, such as tip vortexes, cavitation, turbulent flow, and compressibility/flow issues.

Figure 11:
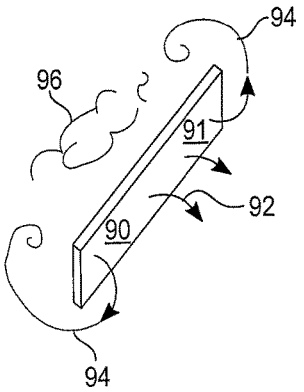
Fig. 11 (Prior Art)
FIG. 11 is a perspective view of a known paddle from a conventional paddle wheel.

Turning to FIGS. 11-19, a study of conventional paddles and blades as used in known paddlewheel-powered boats is presented below, for later contrast with the marine propulsion system 10. A conventional paddle 90 in a paddle wheel (or paddlewheel) is a flat board of wood or metal that pushes against the water as shown in FIG. 11. In order to propel the paddlewheel boat in a forward direction, the paddle 90 pushes water in a rearward direction 92. As the paddle is flat, the rearward facing face 91 of the paddle 90 neither retains nor channels any of the water, and some of the water 94 escapes around the sides, bottom and top of the paddle 90. The paddle leaves behind a turbulent wake 96. One known improvement is a set of feathering linkages that keeps the paddles more or less vertical as the paddles enter, push against and leave the water.

Figure 12:
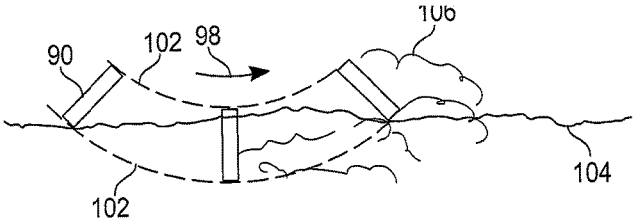
Fig. 12 (Prior Art)
FIG. 12 is a side view of the conventional paddle of FIG. 11 as operated on a conventional paddlewheel-driven boat.

FIG. 12 shows the paddle 90 being swept through an arc of rotation of the paddle wheel. The paddle 90 is moved in a rearward direction 98, pushing against the water along the swept path 102 of the paddle 90. Some of the water along the swept path 102 of the paddle 90 is carried up above the local waterline 104 by the paddle 90, and thrown off of the paddle as thrown water 106. This thrown water 106 exits the paddle 90 in a rearward direction at approximately the tangential velocity of the paddle 90. That is, the thrown water 106 and the paddle are moving at about the same velocity relative to the surrounding water and about a zero velocity relative to each other as the thrown water 106 departs from the paddle 90. While the paddle 90 is mostly to fully submerged, the paddle exerts a force on the water that is proportional to the surface area of the rearward facing face of the paddle and related to the viscosity of the water. When the paddle emerges from the water and throws water at approximately the tangential velocity of the paddle, the paddle experiences very little force as the water departs from the paddle at approximately a zero velocity relative to the paddle. The thrown water 106 is lifted by the paddle 90 and slides off the paddle in a radial direction relative to a hub of the paddle wheel. This lifting and sliding off contributes very little to the reaction force on the paddle and thus contributes little to the forward thrust produced by the paddle wheel. Paddle-wheel-powered boats are thus limited as to maximum speed, in that rotating the paddlewheel more rapidly gets increasingly less efficient in producing thrust. An increasingly large percentage of the energy put into rapidly rotating the paddle-wheel gets used up in producing turbulence.

Figure 13:
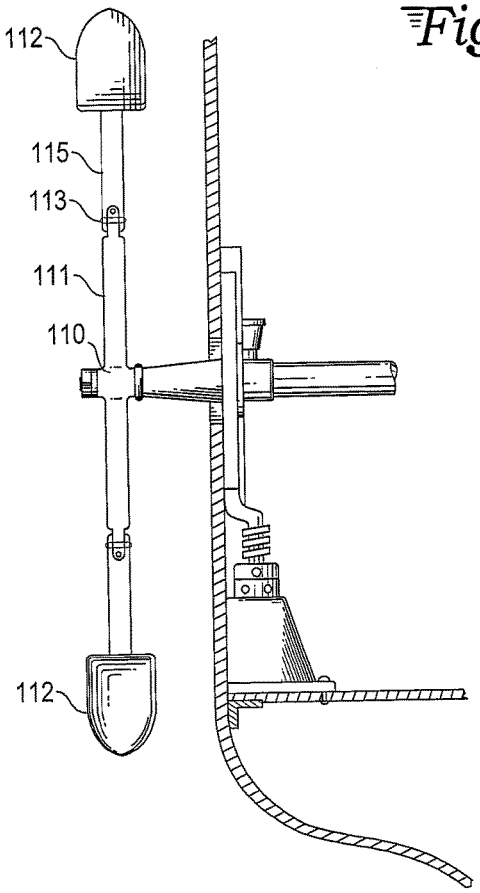
Fig. 13 (Prior Art)
FIG. 13 is a rear view of a known marine propulsion apparatus having blades or paddles mounted to flexible drive arms.
Figure 14:
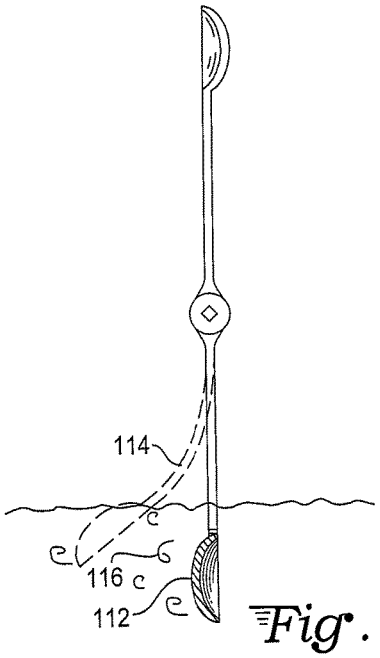
Fig. 14 (Prior Art)
FIG. 14 is a side view of the known blades or paddles and flexible drive arms of FIG. 13.

FIG. 13 shows a known marine propulsion apparatus, from U.S. Pat. No. 1,527,571, with shovel-shaped blades or paddles 112 and flexible drive arms. One version has a flexible drive arm with upper 111 and lower 115 portions connected by a pivot 113. Another version, in FIG. 14, has a flexing arm 114. The blades or paddles 112 are cupped as shown in partial cutaway in FIG. 14. The flexing arm 114, or the pivot 113, allows the blade or paddle 112 to slow abruptly upon striking the water, which reduces entry splashing. Motion of the blade or paddle 112 through the water leaves behind turbulence 116.

Figure 15:
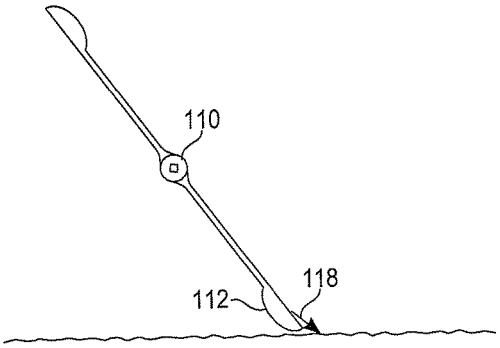
Fig. 15 (Prior Art)
FIG. 15 is a side view of the known blades or paddles and flexible drive arms of FIG. 13, at a relatively low speed of rotation.
Figure 16:
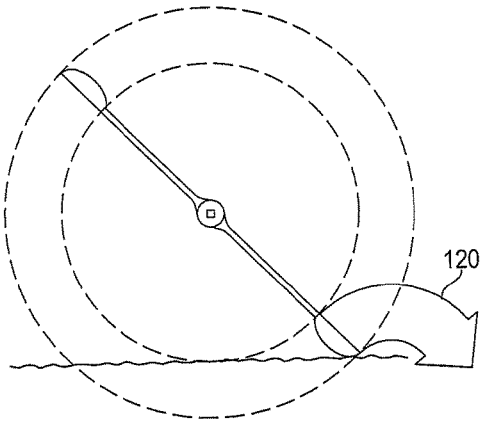
Fig. 16 (Prior Art)
FIG. 16 is a side view of the known blades or paddles and flexible drive arms of FIG. 13, at a relatively higher speed of rotation.

In FIGS. 15 and 16, the known blade or paddle 112 continues rotating about the hub 110. Water scooped up by the blade or paddle 112 then pours out of the cupped blade or paddle 112 when the hub 110 is rotated at a modest pace, as in FIG. 15. Water scooped up by the blade or paddle 112 is thrown out of the cupped blade or paddle 112 when the hub 110 is rotated at a more rapid pace, as in FIG. 16. As with the paddle 90 in FIGS. 11 and 12, the thrown water 120 exits the blade or paddle 112 at approximately the tangential velocity of the blade or paddle 112. The flexible drive arm from U.S. Pat. No. 1,527,571 gives the thrown water 120 an extra kick as the flexible drive arm straightens, contributing to the forward thrust expressed on the hub 110 and the boat. Relative to the blade or paddle 112, the thrown water 120 would have a slightly positive velocity arising from the extra kick, but this paddle-relative velocity would still be less than the paddle-relative velocity at which the water was scooped.

Figure 17:
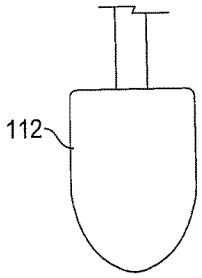
Fig. 17 (Prior Art)
FIG. 17 is an elevated view of a known blade or paddle from FIG. 13.
Figure 18:
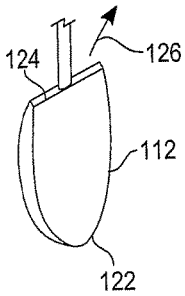
FIG. 18 is a perspective view of the known blade or paddle from FIG. 17, showing how water would be directed if just the tip of the blade or paddle were submerged.
Figure 19:
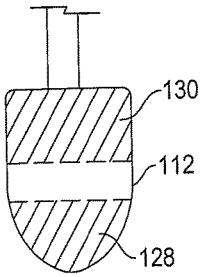
FIG. 19 is an elevated view of the known blade or paddle from FIG. 17, showing water entry and exit regions for hypothetical operation as described in FIG. 18.

FIGS. 17-19 show the known blade or paddle 112 in a hypothetical operation. U.S. Pat. No. 1,527,571 discloses that the depth of engagement of the blades can be adjusted in order to regulate the speed of propulsion. If the depth of engagement of the blades were adjusted so that just the tip 122 of the blade or paddle 112 were submerged, although the reference does not so direct, water would be scooped by the tip 122 and directed upward. Water would exit off of the upper edge 124 of the blade or paddle 112 in a mostly upward direction 126, canted slightly rearward by the slight curvature in the upper portion of the cupped blade or paddle 112, as shown in FIG. 18. Water would be scooped into an entrance region 128 of the blade or paddle 112 and directed to exit from an exit region 130 of the blade or paddle 112. As the area of the exit region 130 projected onto the entry water flow is greater than the area of the entrance region 128 projected onto the exit water flow, the cross-section of the exit water flow is greater than the cross-section of the entry water flow, and the flow of water would not be narrowed. The velocity of water exiting the exit region 130, relative to the blade or paddle 112, would be strictly less than the velocity of the water being scooped up into the entrance region 128, relative to be blade or paddle 112. Such operation would not produce as much forward thrust as the fully submerged blade or paddle 112, and would not likely be employed, except perhaps to slow the progress of the boat if the motor could not be throttled down.

Figure 20:
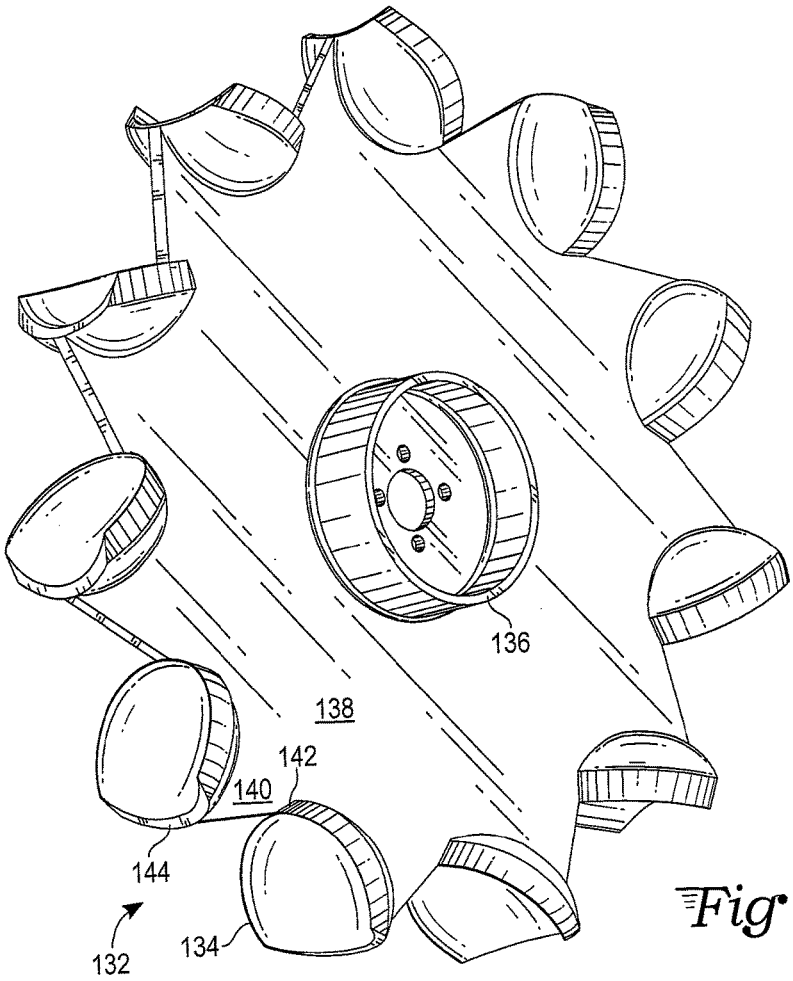
FIG. 20 is a perspective view of a further embodiment of a propulsion wheel with water-directing scoops, suitable for use in the marine propulsion system of FIG. 1.

In contrast to how known blades or paddles from paddle wheels operate in known or hypothetical situations, FIGS. 20-27 show operation of a further embodiment of the propulsion wheel with water-directing scoops. In FIG. 20, a propulsion wheel 132 has a plurality of water-directing scoops 134 or water-channeling members. The water-directing scoops 134 are radially arrayed about a hub 136. The scoops 134 are connected to the hub 136 by a solid wheel in the embodiment shown. Further embodiments use spokes, or spokes and a rim to connect the scoops 134 to the hub 136. Sawtooth regions 140 connect a top 142 of one scoop to a bottom 144 of the next scoop in succession around the hub 136. The sawtooth regions 140 provide clearance for the exiting water jet, the production of which during operation is discussed below.

Figure 21:
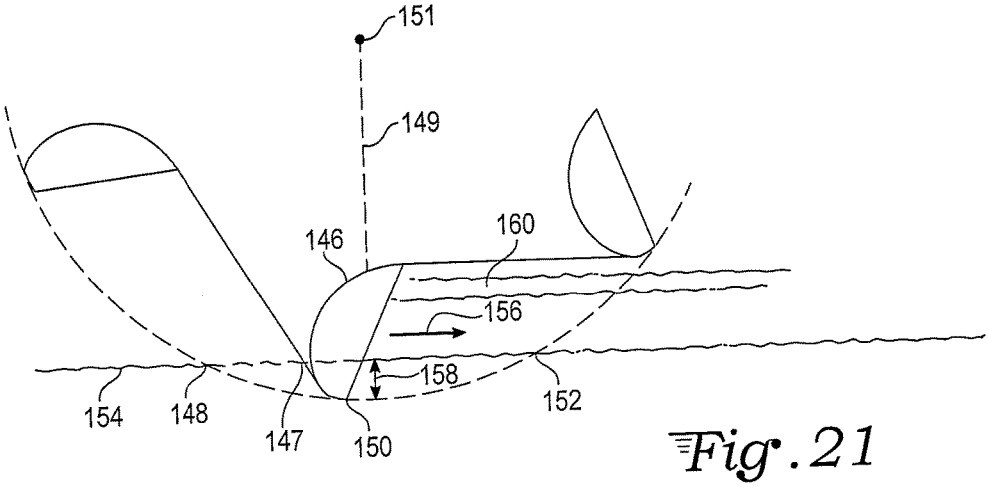
FIG. 21 is a side view of a portion of the propulsion wheel with water-directing scoops of FIG. 20. One of the scoops is directing scooped water to exit the scoop as a narrowed, high-speed jet of ejected water.

FIG. 21 shows the propulsion wheel 132 in action. A scoop 146 descends from above the local or apparent waterline 154, starts dipping into the water at a scooping entry position 148, continues in a rearward direction 156 to a scoop depth 158 at a mid-scooping position 150, continues in the rearward direction to exit the water at a scooping exit position 152 and then ascends above the local or apparent waterline to continuing rotation about the hub (not shown, but see FIG. 20). Ejected water 160 is at a greater velocity relative to the scoop than a velocity of the scoop relative to the surrounding water at the local or apparent waterline. The scoop depth 158 is, in various embodiments, about one third the height of the scoop or between about one quarter and one half the height of the scoop.

At low speeds of hub rotation, water fills in behind the scoop 146 as the scoop 146 travels through the arc of rotation into, through and out of the water. At high speeds of hub rotation, the scoop 146 digs a trench through the water, and air backfills the scooped region 147 behind the scoop 146. In this manner, cavitation is avoided. This can be compared and contrasted with operation of a fully submerged paddle or scoop, which would produce cavitation at high speeds.

Figure 22:
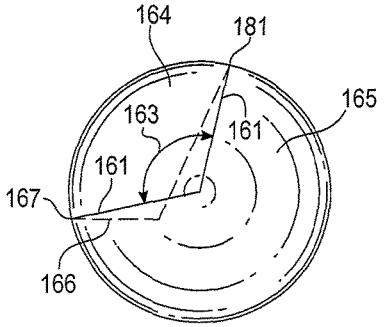
FIG. 22 is a side view of a sphere, which can be sectioned to produce one embodiment of a scoop suitable for the propulsion wheel of FIG. 20.

FIG. 22 shows one embodiment of a scoop 164 being created as a section of a sphere 165. This action is conceptual in nature, and the scoop 164 can be manufactured using known materials and means such as molding, forging, carving, stamping etc. The resultant scoop 164 has an approximately constant or spherical radius, and a concave interior with a truncated hemispherical shape. A normal to the interior surface of the scoop 164, i.e. a radius 161 of the sphere 165, sweeps an angle of about one third of 360 degrees, i.e. about 120 degrees, from the lowermost point 167 of the bottom edge 166 of the scoop to the top point 181 of the scoop. Further embodiments have concave interiors with a smoothly rounded interior shape or an ovoid shape. Further embodiments have concave interiors with a normal to the interior of the scoop sweeping an angle of at least about 90 degrees from the bottom of the scoop to the top of the scoop, i.e. subtending a similar angle to one quarter of a sphere although the concave interior is not necessarily spherical. Still further embodiments have concave interiors with a normal to the interior of the scoop sweeping a total angle of at least about 70 degrees, at least about 80 degrees, at least about 110 degrees, at least about 130 degrees, and between about 90 degrees and about 180 degrees from the bottom edge to the top edge of the scoop, i.e. subtending an angle similar to between a quarter of a sphere to a hemisphere although the concave interior is not necessarily spherical. Still further embodiments have the above angles and a truncated bottom edge.

Figure 23:
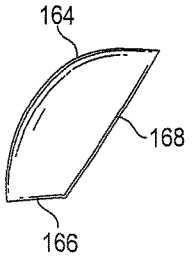
FIG. 23 is a side view of a scoop produced as shown in FIG. 22.

FIG. 23 is a side view of the scoop 164. The truncations to the sphere produce a truncated bottom edge 166 and a truncated front face edge 168.

Figure 24:
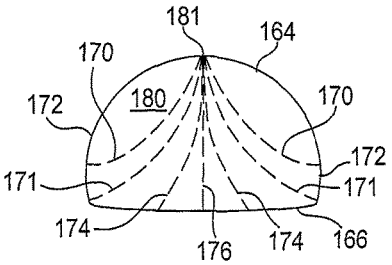
FIG. 24 is a rear view of the scoop of FIG. 23, showing how water is directed by the shape of the scoop.

FIG. 24 shows the rearward facing concave interior 180 of the scoop 164. The concave interior faces in a rearward direction when scooping water to produce a forward thrust. Dashed lines 170, 171, 174 indicate how water is directed by the shape of the scoop. Water scooped from the bottom edge 166 and sides 172 of the scoop 164 is directed toward a centerline 176 of the interior of the scoop. Water scooped from the sides 172 of the scoop 164 is directed by these sides 172 towards the centerline 176, along side to top flow lines 170. Water from the sides 172 of the scoop is directed upward along flow lines 170, 171 by the water flowing upward along flow line 174 and centerline 176 from the bottom edge 166 of the scoop 164. Water from the bottom edge 166 of the scoop 164 is directed along flow lines 171, 174 towards the centerline 176 by the water from the sides 172 of the scoop. The resultant flow from the bottom edge 166 and sides 172 of the scoop 164 narrows and flows along the flow lines 170, 171, 174 and centerline 176 towards a top point 181. Water being essentially incompressible, this narrowing of the flow towards the top point 181 results in an increase in velocity of the water flow.

Figure 25:
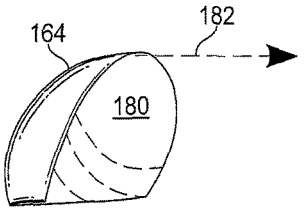
FIGS. 25-27 are perspective views of the scoop of FIG. 23, showing how water is directed to form the narrowed, high-speed jet of ejected water.
Figure 26:
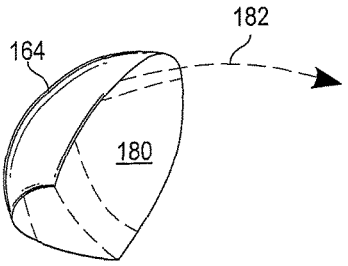
Figure 27:
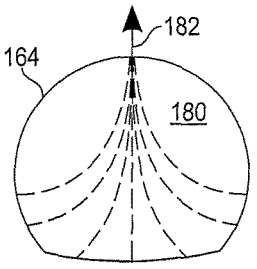

FIGS. 25-27 show the direction 182 of the resultant flow of water exiting the scoop 164 as ejected water in a high-speed water jet. The water flow is essentially laminar.

Figure 28:
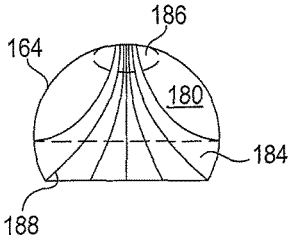
FIG. 28 is a front view of the scoop of FIG. 23, showing how water is directed from a water-intake or entry region to a water exit or ejection region, with the flow narrowing and speeding up along the way.
Figure 29:
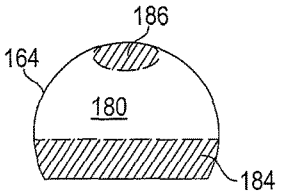
FIG. 29 is a front view of the scoop of FIG. 23, showing water entry and exit regions.

FIGS. 28 and 29 show a water-intake or entry region 184 and a water ejection or exit region 186 of the scoop 164. The water entry region 184 and the water exit region 186 are each depicted as bounded by dashed lines and solid outline in FIGS. 28 and 29, with the regions connected together by water flow lines 188 in FIG. 28 and shaded in FIG. 29. The water entry region 184 is the region or area of the concave interior 180 of the scoop 146 that sweeps water when the scoop is at the scoop depth 158, as shown in FIG. 21. The water entry region 184 includes the bottom, lower sides and lowermost portion of the interior of the scoop 164. Projecting the water entry region 184 of the scoop 164 onto a cross-section of the water being scooped allows definition of a scooping flux as a volume over time rate of water intake. The scooping flux or intake flux (or flow rate) is thus defined as the velocity of the water relative to the scoop, i.e. the negative of the velocity of the scoop relative to the water, multiplied by the cross-section area of the water being scooped. The water exit region 186 is the region or area of the concave interior 180 of the scoop 146 that projects onto the exit flow of water, allowing definition of an ejection flux as a volume over time rate of water ejection. The water exit region 186 is in the uppermost portion of the interior of the scoop 164. The ejection flux or exit flux (or flow rate) is thus defined as the velocity of the water being ejected by the scoop, relative to the scoop, multiplied by the cross-section area of the ejected water jet. Water being incompressible, the ejection or exit flux equals the scooping or intake flux, i.e. the same amount of water is ejected as was scooped, and the mass or volume flow rate of water ejection is the same as the mass or volume flow rate of water scooping or intake. With the projected cross section of exit flow being of a smaller area than the projected cross section of the intake or entry flow of water, the ejection velocity is greater than the entry or scooping velocity, relative to the scoop and the water. Therefore, the scoop-relative water ejection or exit velocity is greater than the scoop-relative water intake or entrance velocity.

Embodiments of the scoop thus have a water-acceleration shape, defined as a shape of the scoop that accelerates water so that the water is ejected at a greater velocity than the water was scooped. Specifically, with the scoop at a mid-scooping position during operation, a scoop-relative exit velocity of water being ejected from the water exit region is greater than a scoop-relative entrance velocity of water being scooped up the water entry region.

Referring back to FIG. 21, and with continuing reference to FIGS. 23-29, an aspect of the positioning of the scoops 146 in the propulsion wheel 132 affects the direction in which the ejected water 160 is aimed. A portion of the water exit region 186 proximate to the top point 181 of the scoop 164 is approximately perpendicular to a radius 149 from the center 151 of the hub to the scoop. This portion of the water exit region 186 is an exit-directing region that directs the water being ejected approximately along a tangent to the rotation arc of the scoop about the hub. When the scoop 164 is at the mid-scooping position, this portion of the water exit region 186 is approximately horizontal and the ejected water 160 is aimed approximately horizontally. Reaction thrust of an equal magnitude and in an opposed direction is then approximately horizontal, to provide forward thrust to the marine vessel.

Figure 30:
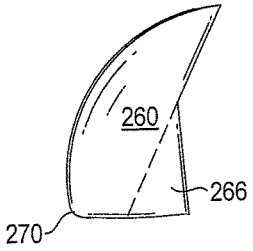
FIG. 30 is a side view of a further embodiment of the scoop of FIG. 23.
Figure 31:
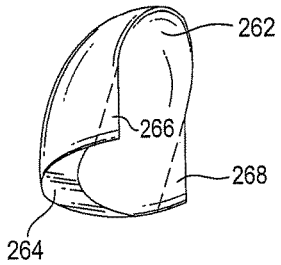
FIG. 31 is a perspective view of the scoop of FIG. 30.

FIGS. 30 and 31 show an embodiment of a scoop 260 that has extended side panels 266, 268 and a bottom web 264. The extended side panels 266, 268 extend forward of the main body of the scoop 260, and serve to more efficiently gather water being scooped and create less side splashing as compared to the embodiment of the scoop shown in FIG. 23. The bottom web 264 extends forward of the main body of the scoop 260 at the lower edge of the scoop 260, and serves to more efficiently gather water being scooped and create less water loss out and down past the lower edge of the scoop 260, as compared to the embodiment of the scoop shown in FIG. 23. The scoop 260 has an exit-directing region 262 that is a portion of the concave interior of the scoop 260. The exit-directing region 262 directs the exit water flow, and can be aimed horizontally relative to the surface of the water being scooped so as to maximize rearward water ejection and forward thrust.

Figure 32:
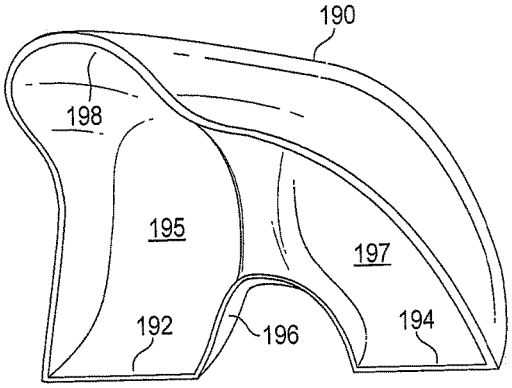
FIG. 32 is a perspective view of a forked scoop, which is related to the water-channeling member of FIG. 5.
Figure 33:
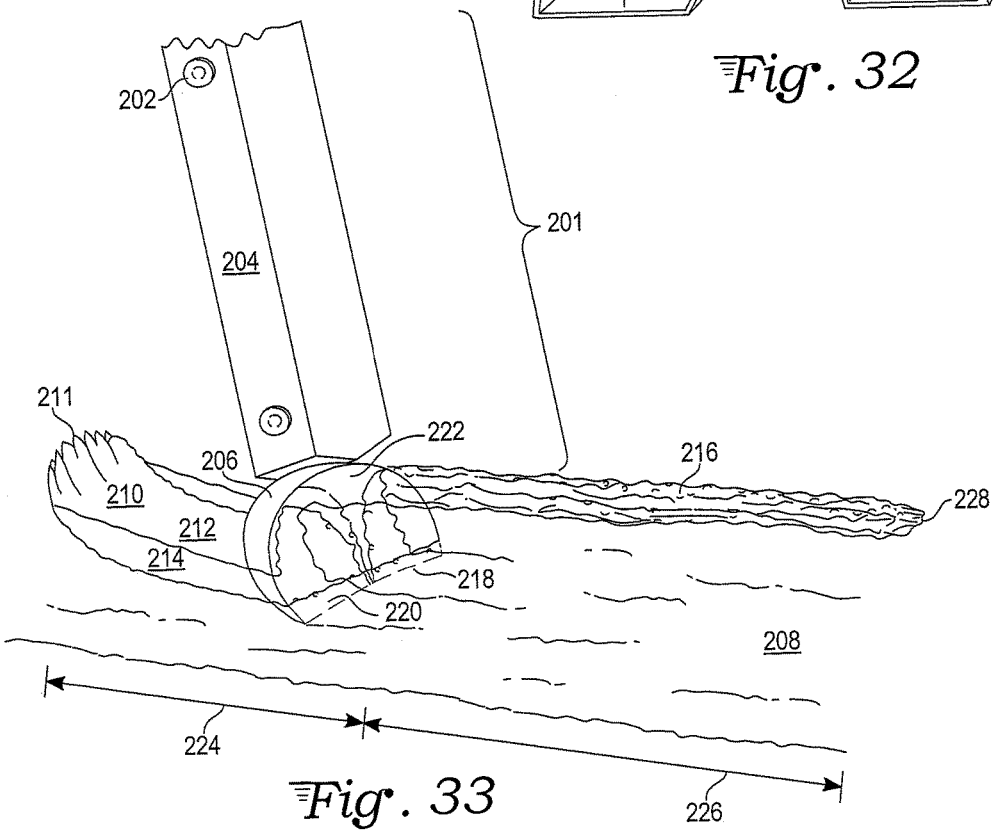
FIG. 33 is a perspective view of a realized experimental apparatus demonstrating an embodiment of a water-directing scoop of FIG. 20. The scoop redirects a flow of water being scooped and forms a high-speed jet of water as the ejected water flow.

FIG. 32 shows a forked scoop 190 that is a variation of the split or fork-shaped water-channeling member of FIG. 5. Each forked leg 195, 197 or fork tine has a respective floor 192, 194 or web which slices into the water as the scoop 190 scoops water. Water is routed up along each forked leg 195, 197 from the respective floors 192, 194 towards the exit point 198 of the scoop 190. An inverted "V" or inverted "U" crease 196 or cutaway at the centerline of the cup separates the two split or forked legs 195, 197. The crease 196 or cutaway provides clearance for the jet of water produced when the next forked scoop 190 scoops water in succession after the previous forked scoop 190 does so. This allows closer placement of successive scoops in a propulsion wheel, thereby allowing a greater number of scoops in the propulsion wheel for a specified diameter of the wheel and specified scoop size.

FIG. 33 depicts an experimental apparatus 201 with a realized embodiment of a water-directing scoop 206. The experimental apparatus 201 is an actual reduction to practice of an embodiment. A rotational pivot 202 acts as a hub for an arm 204. The arm 204 is representative of an attachment means rigidly attaching the scoop 206 to the rotational hub. The water-directing scoop 206 is shown just after a mid-scooping position, having entered the water 208. The scoop 206 has been moved at high-speed into the water 208 and is "digging" or forming a trench 210 in the water 208. The bottom edge 218 of the scoop 206 has formed a floor 212 of the trench 210. The lower region 220 of the scoop 206 has formed the side walls 214 and floor 212 of the trench 210. Water being scooped is redirected by the scoop 206 and exits a top region 222 of the interior of the scoop 206. The exiting water flow is a high-speed jet 216 of water as the ejected water flow. This top region 222 is approximately perpendicular to a radius from the rotational pivot 202 to the scoop 206, and directs the high-speed jet 216 of water approximately horizontally or parallel to the water 208 as the scoop 206 travels through the mid-scooping position. The portion of the arm 204 shown attaching the scoop 206 to the rotational pivot 202 approximates a radius from the rotational pivot 202 or the hub to the scoop 206.

Relative lengths 226, 224 of the exiting water high-speed jet 216 and the trench 210 can be compared to provide insights about the relative velocities of the scoop 206 and the ejected water flow. In the time that the scoop 206 takes to scoop up water and dig the trench 210, the scoop has traveled a trench length 224, measured from an upward splash 211 at the leading edge of the trench 210 to the depicted scoop location. In this same period of time, the leading edge 228 of the exiting water flow high-speed jet 216 has traveled an ejected water flow length 226, measured from the depicted scoop location to the leading edge 228 of the exiting water flow high-speed jet 216. Since the time periods are equal, the ratio of the relative velocities is equal to the ratio of the relative lengths. The velocity of the exiting water flow high-speed jet 216 relative to the scoop, divided by the velocity of the scoop 206 relative to the water 208 is equal to the ejected water flow length 226 divided by the trench length 224. The conclusion from the experiment depicted in FIG. 33 is that the ejected water flow length 226 is greater than the trench length 224, therefore the velocity of the exiting water flow high-speed jet 216 relative to the scoop 206 is greater than the velocity of the scoop 206 relative to the water 208. The experiment depicted in FIG. 33 thus supports the theory of operation.

With reference to FIGS. 34-37, a further experiment is depicted. This experiment constitutes a further actual reduction to practice of an embodiment. A water-directing scoop 230 is attached to a spoke 232, which rotates about a hub (not shown, but readily devised). As in the experimental apparatus depicted in FIG. 33, the scoop 230 descends into the water 234, scoops some of the water up, directs the water to form a high-speed jet of ejected water flow 244, and exits the water 234. FIGS. 34-37 depict four successive frames of video, captured at 30 frames per second, i.e. each frame is separated from the preceding or following frame by 1/30 of a second. In order to more clearly observe how the scooped and ejected water flow behaves, groups of "particles" are employed in the water 234. This is similar to using smoke when investigating air flow behavior in a wind tunnel, during the testing of airfoils or other aerodynamic structures. The particles in the experiment are breakfast cereal rings, although other particles or small objects could be used. Two groups 236, 238 of particles are shown. The groups 236, 238 of particles are initially at rest, floating on the surface of the water 234 ahead of the scoop 230 prior to the entry of the scoop 230 into the water 234.

Figure 34:
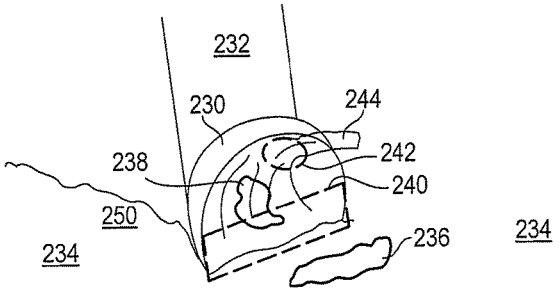
FIGS. 34-37 are perspective views in a time sequence, of an experimental apparatus that is a further embodiment of the apparatus of FIG. 33. Macroscopic objects in the water act as "particles", and are seen as groups being scooped and ejected with the water.

In the first frame, shown in FIG. 34, the scoop has already descended into the water 234 and is approximately at or just past the mid-scooping position, leaving a wall 250 of water at the borders of where the scoop has traveled. The first group 238 of particles is being scooped up by the scoop 230, having passed through an entrance cross-section 240 of water being scooped by the scoop 230. A second group of particles 236 is at rest on the surface of the water 234 ahead of the scoop 230. The first group 238 of particles is traveling along with the scooped water, and is heading up along a centerline of the scoop 230 towards an exit cross-section 242 of water being ejected. The ejected water flow 244 is just emerging from the top of the scoop 230. An entrance region of the scoop can be derived by projecting onto the scoop 230 the entrance cross-section 240 of water being scooped. An exit region of the scoop can be derived by projecting onto the scoop 230 the exit cross-section 242 of water being ejected.

Figure 35:
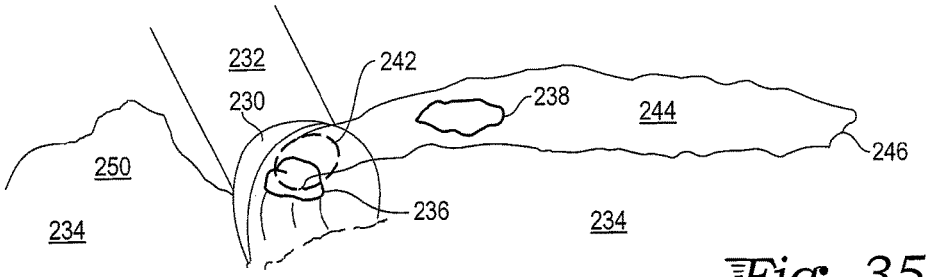

In the second frame, shown in FIG. 35, 1/30 of a second has elapsed since the previous frame, and the scoop has traveled a distance of approximately or just slightly greater than the distance separating the first group 238 and the second group 236 of particles. In this same period of time, the leading edge 246 of the ejected water flow 244 has traveled a much greater distance relative to the scoop 230, indicating the velocity of the water flow relative to the scoop 230 is much greater than the velocity of the scoop relative to the surrounding water 234. The first group 238 of particles is elongating as a result of the increase in velocity of the water flow, and is seen as located approximately 1/3 of the distance from the scoop 230 to the leading edge 246 of the ejected water flow 244. The second group 236 of particles is approximately midway up the interior of the scoop 230, having passed through the entrance cross-section 240 of water being scooped by the scoop 230, and is approaching the exit cross-section 242 of water being ejected. The exit cross-section 242 of water being ejected has expanded, as the flow of water has increased in cross-section. The exit cross-section 242 of water being ejected, even as expanded, is less than the area of the cross-section 240 of water being scooped. Two walls 250 of water, to either side of the trench being formed in the water 234 by the scooping action, are growing in length and height. The cross-section 240 of water being scooped is now decreasing as compared to the mid-scooping position, as the scoop 230 is starting to withdraw from the water 234.

Figure 36:
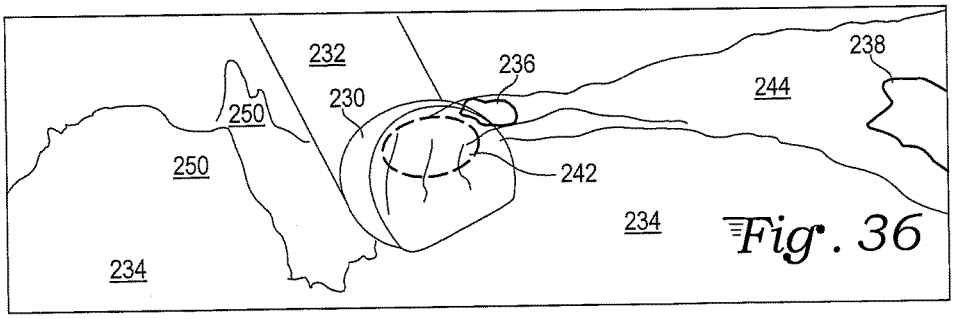

In the third frame, shown in FIG. 36, 1/30 of a second has elapsed since the previous frame, and the scoop has traveled a similar distance as between the first and second frames, at a similar velocity relative to the water 234. In this period of time, the leading edge of the ejected water flow 244 has traveled beyond the edge of the video frame, and the first group 238 of particles is in the process of doing so. The second group 236 of particles is departing from the exit cross-section 242 of water being ejected by the scoop 230. A distance between the first 238 and second 236 group of particles is greatly increased as compared to the previous frame, indicating the increase in velocity of the ejected water flow 244. The two walls 250 of water to either side of the scooped region in the water 234 continue to grow in length and height. The scoop 230 has just exited the water 234, so the entrance cross-section of water being scooped by the scoop 230 is now zero. The last of the water scooped up when the scoop was still in the water 234 still has forward momentum as directed by the curvature of the interior of the scoop 230 and continues up the interior of the scoop 230 towards the exit cross-section 242 of water being ejected.

Figure 37:
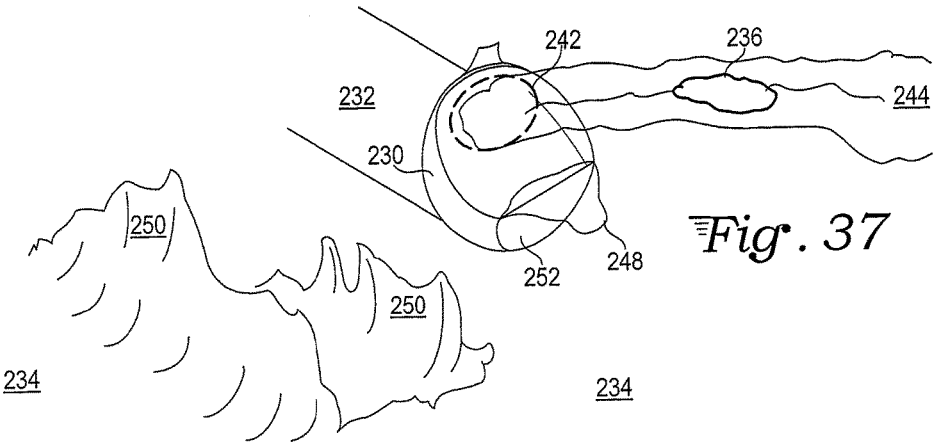

In the fourth frame, shown in FIG. 37, 1/30 of a second has elapsed since the previous frame, and the scoop has traveled a similar distance as between the first and second frames or between the second and third frames, and at a similar velocity. Changes in the rotation angle of the spoke 232 from one frame to the next are consistent with a relatively constant rotation rate of the scoop 230 about the hub (not shown), as would be the case with multiple scoops in a rotation wheel of a propulsion apparatus. The scoop 230 has exited the water 234, leaving behind the two walls 250 of water, which will soon collapse to refill the trench. The leading edge of the ejected water flow 244 is well beyond the edge of the video frame, as is the first group 238 of particles. The second group of particles 236 is elongating as a result of the increased velocity of the water flow, and traveling beyond the exit cross-section 242 of water being ejected. In the experiment depicted, the two groups 236, 238 of particles ended up about 20 feet away, with some of the particles ending as far as about 24 feet away from the furthermost extent of the scoop 230.

The conclusion from the experiment depicted in FIGS. 34-37 is that the velocity of the ejected water flow 244 relative to the scoop 230 is greater than the velocity of the scoop 230 relative to the water 234. A further conclusion is that the exit cross-section 242 of water being ejected by the scoop 230 is less than the entrance cross-section 240 of water being scooped, at and just after the mid-scoop position, which is consistent with the relative velocities of the water being ejected and being scooped. This further experiment depicted in FIGS. 34-37 thus supports the theory of operation.

Water scooped up by the scoop 230 is primarily ejected out through the exit cross-section 242 of water being ejected. However some of the remaining water in the scoop 230 is spilled out past the web 252 at the bottom of the scoop 230 as a bottom spill 248 of water, as shown in FIG. 37. The reason for this is that the bottom spill 248 of water is not forced upward in the scoop by intake water being scooped, as the scoop has departed from the water 234 and is no longer scooping additional water.

There is a trade-off between embodiments of scoops having and not having a bottom web. The bottom web 252 increases the scooping action, in that water is less likely to escape below the scoop 230 during scooping. However, the presence of a web 252 at the bottom of the scoop 230 delays the departure of the bottom spill 248 of water after the scoop 230 has left the water 234. This trade-off may affect efficiency at differing rotation speeds of a propulsion wheel and/or for differing shapes of scoops. Accordingly, embodiments having a bottom web include a web with a straight edge, a web with an inwardly curving edge, a web with an outwardly curving edge, a web with a notched edge, or a web with an inverted "V" or inverted "U" shape. Embodiments lacking a bottom web include a truncated bottom edge, an inwardly rounded bottom edge, an outwardly rounded bottom edge, an angled bottom edge, or a beveled bottom edge.

Generally, embodiments of water-channeling members or scoops are symmetric about a centerline, i.e. laterally symmetric. The members or scoops are generally rigidly connected to a motor-driven or otherwise powered, rotatable hub. Each scoop generally has a rounded, concave interior that is non-faceted and faces a rearward direction relative to scooping water and the forward propulsion direction for the vessel. However, embodiments could be laterally asymmetric, for example for left-hand and right-hand propulsion wheels as will be further discussed, or for staggered mounting about a centered propulsion wheel. Embodiments of water-channeling members or scoops can be taller, shorter, wider, or narrower than the examples shown, can be forked or non-forked, and can have constant radius, increasing radius, decreasing radius or other types of curvature. Embodiments can have a truncated scooping end, a webbed or floored scooping end or a curved scooping end.

The water-directing scoop encounters the water at a controlled depth. Because the scoop is moving relative to the water, the scoop acts upon the water by forcibly accelerating the water using direct contact with the concave face of the scoop. The water that is in contact with the concave face of the scoop travels in a direction defined by the slope of the surface, i.e. towards the center of the cup. In the middle of the scoop, the water travels upward because there is nothing to impede it. Downward presence of water restricts that flow path and adding a webbed lip aids as well. The sides of the concave face of the scoop wrap to a fairly steep angle at the point of contact and the water on this face also travels towards the center of the cup, which is towards the center line and somewhat upward from the point of water accumulation. When all the water flow gathers along the centerline of the scoop, the water is merged into a combined high energy flow that is already flowing upward and is curled by the convex face of the scoop into a high speed combined jet aimed roughly horizontally. The initial burst of ejected water has the most velocity and therefore energy content. The energy/velocity trails off as the scoop is raised out of the water, so that by the 90 degree point the spherical cup is simply emptying itself. The last bit of water is slung at some meaningful velocity by centrifugal forces. All of the water picked up, i.e. scooped and then ejected, has a significant amount of energy that has been imparted to it, and this has been accomplished with minimal conversion energy loss.

FIGS. 38, 40, 43 and 44 show further embodiments of the marine propulsion system in marine vessels with two propulsion wheels 282, 284. In these embodiments, the left-side propulsion wheel 282 and the right-side propulsion wheel 284 can be operated together at the same forward speed for forward propulsion, operated together at the same reverse speed for reverse propulsion, operated at different speeds for turning in a forward propulsion mode or at different speeds for turning a reverse propulsion mode, or operated in opposing rotation directions for rotation about an axis of the vessel. Reverse propulsion is less efficient than forward propulsion, as the reverse propulsion does not make use of the water acceleration feature of the scoops on the propulsion wheels. However, this flexibility in operation of the two propulsion wheels allows greater maneuverability of a marine vessel than do ordinary propeller-based systems e.g. as with standard inboard and outboard motors, excepting vessels equipped with bow thrusters and side thrusters.

Figure 38:
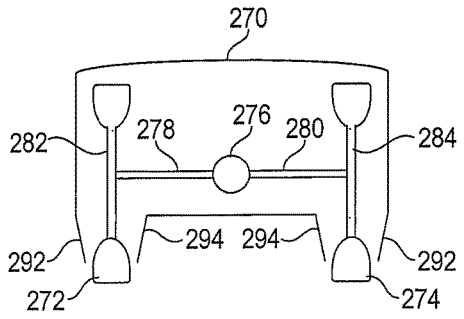
FIG. 38 is a schematic view of a further embodiment of the marine propulsion system of FIG. 1, with two propulsion wheels.

With reference to FIG. 38, a marine vessel 270 has a left-side propulsion wheel 282 driven by a left-side coupling shaft 278, and a right-side propulsion wheel 284 driven by a right-side coupling shaft 280. A drive unit 276 is coupled to the left-side coupling shaft 278 and the right-side coupling shaft 280, and can drive the shafts as described above. For example, the drive unit 276 can include two independently controlled motors, one of which drives the left-side components and the other of which drives the right-side components. The motors can be, for example electric motors or internal combustion engines. As a further example, the drive unit 276 can include a single motor and a transmission or transfer case with controls for independent differential or reverse drive of the left-side components and the right-side components, driving the shafts as described above. In a further embodiment, the left-side coupling shaft 278 and the right-side coupling shaft 280 are equipped with universal joints much as on an independent rear suspension of an automobile. Suspension members, such as shock absorbers, springs and suspension links, can allow the left-side propulsion wheel 282 and the right-side propulsion wheel 284 to move up and down independently. In one embodiment, both the left-side scoops 272 and the right-side scoops 274 are symmetric. In a further embodiment, the left-side scoops 272 are asymmetric, and the right-side scoops 274 are mirror images of the left-side scoops 272, i.e. the right-side scoops 274 are asymmetrical and are correspondingly matched to the left-side scoops 272. Symmetric and asymmetric scoops are further discussed below.

Figure 39:
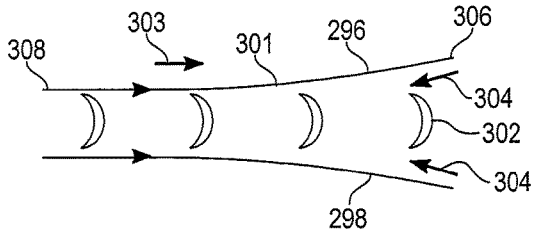
FIG. 39 is a schematic view of a water-ram tunnel that increases the volume of water available to the marine propulsion system of FIG. 1.

FIG. 39 shows a water-ram tunnel 301 with walls 296, 298 that taper from an entrance 306 to an exit 308 of the water-ram tunnel. Using forward motion in a forward direction 303, e.g. forward motion of a vessel to which the propulsion system is attached, water arriving at the entrance 306 is pushed diagonally inward 304 towards the arriving scoop 302. The scoop 302 then scoops up the water and proceeds towards the exit 308 of the water-ram tunnel, discharging a high-speed water jet in a rearward direction, providing a thrust in the forward direction 303. In this manner, the water-ram tunnel increases the volume of water available to the scoop 302, as compared to a tunnel with straight, non-tapered walls. In one embodiment, the water-ram tunnel 301 is formed by the outer and inner hull walls 292, 294 of the marine vessel 270. With symmetric walls 296, 298, the diagonally inward 304 water flow is symmetric to left and right side, and the scoops 302 can be symmetric. In a further embodiment, the water-ram tunnel 301 is formed by the side walls 36 and 38 on opposite sides of the propulsion wheel 30, as shown in FIGS. 1-4.

Figure 40:
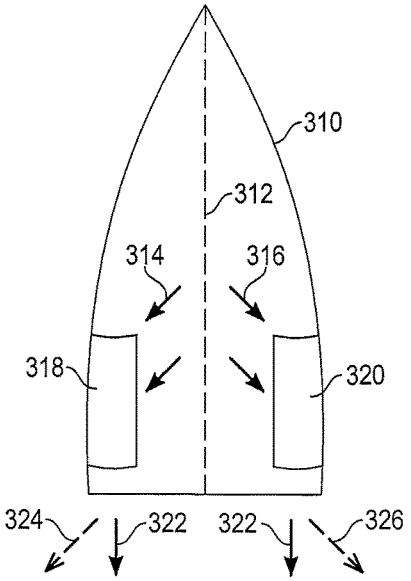
FIG. 40 is a schematic view of a deep"V" hull marine vessel with two propulsion wheels, as a further embodiment of the marine propulsion system of FIG. 1.

FIG. 40 shows a marine vessel 310 with a deep"V" hull, the centerline 312 of which is shown as a dashed line. The deep "V" hull displaces water diagonally laterally 314, 316 as the hull proceeds forward through the water. In this embodiment, the marine vessel 310 has two propulsion wheels 318, 320, mounted on opposing sides of the centerline 312. The left-side propulsion wheel 318 receives water that is displaced diagonally laterally 314, in contrast to the single-propulsion wheel embodiments which generally receive water head on. The right-side propulsion wheel 320 receives water that is displaced diagonally laterally 316 in a mirror image of the water received by the left-side propulsion wheel 318. For this reason, asymmetric scoops can be employed in embodiments having two propulsion wheels. It is desired that the scoops on the left-side propulsion wheel 318, receiving incoming water from the front and right, should eject the water in a rearward direction 322 rather than in a rearward and leftward direction 324. Similarly, the scoops on the right-side propulsion wheel 320, receiving incoming water from the front and left, should eject the water in a rearward direction 322 rather than in a rearward and rightward direction 326. By having the scoops on both left and right sides eject water in the rearward direction 322, forward thrust is maximized without having portions of the vector sum of water ejection in the rearward and leftward direction 324, and rearward and rightward direction 326, cancel out.

Figure 41:
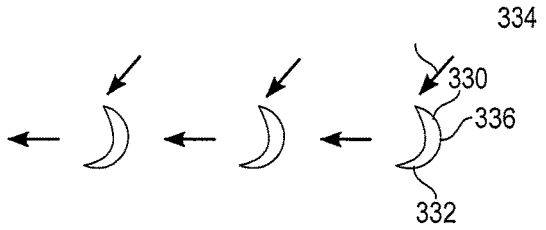
FIG. 41 is a schematic view of asymmetric scoops in action on the marine vessel of FIG. 40.

FIG. 41 shows asymmetric scoops 336 with a side-loading feature, such as can be employed on the right-side propulsion wheel 320 of the marine vessel 310. Mirror images of these scoops 336 can be up employed on the left-side propulsion wheel 318. Water is showing arriving in a diagonal direction 334, heading towards the left-side wall 330 of the scoop 336. In order to increase the amount of water the scoop 336 can take in, the left-side wall 330 is foreshortened, relative to a symmetric scoop. By contrast, the right-side wall 332 is elongated, relative to a symmetric scoop. The elongation of the right-side wall 332 assists the side-loading of water arriving in the diagonal direction 334, and also guides the ejected water in a more rearward direction rather than allowing the water to escape in a rearward and rightward direction. In one embodiment, the shape of the scoop itself is asymmetric. In a further embodiment, a symmetric scoop is used, but is mounted asymmetrically as by rotating or tilting the scoop relative to the symmetric mounting of a symmetric scoop.

Figure 42:
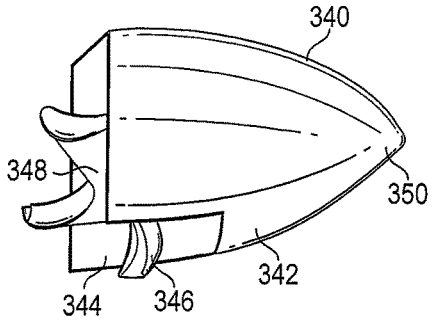
FIG. 42 is a perspective view of a fairing for a propulsion wheel, in an embodiment of the marine propulsion system of FIG. 1.

FIG. 42 shows a fairing 340 for the propulsion wheel 348. The fairing 340 has an opening 344 through which the scoops 346 travel into and out of the water being scooped and ejected. A lower region 342 of the fairing 340 can act as a waterline-adjusting device. A lower and forward region 350 of the fairing 340 is raised above the lower region 342 of the fairing, so that the two portions of the fairing 340 can smooth out waves or ripples on the surface of the water, in order to avoid swamping the propulsion wheel 348, which would greatly decrease propulsion efficiency. The two portions of the fairing 340 thus coordinate to present a lower variation in height of the apparent waterline as compared to the waves or ripples on the surface at the local waterline. Further, the fairing 340 reduces air resistance to the otherwise exposed portions of the propulsion wheel 348.

Figure 43:
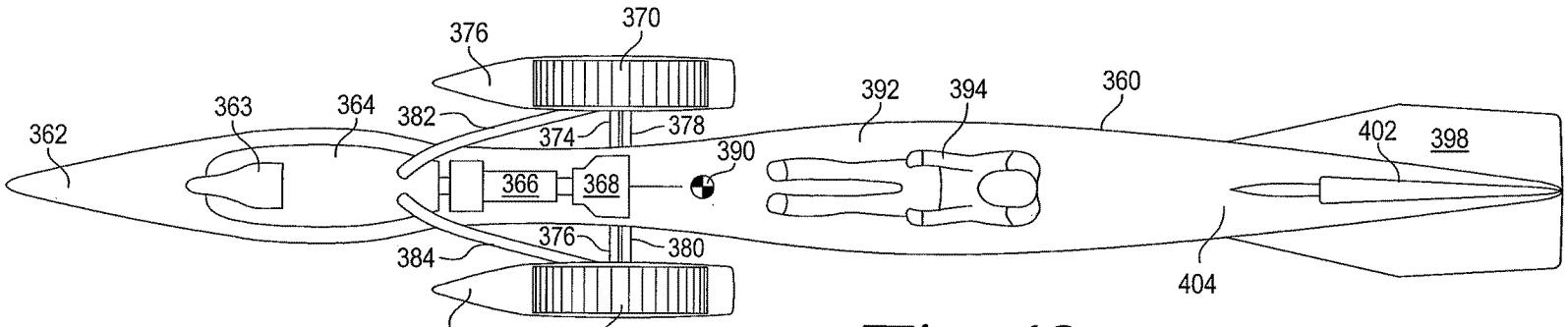
FIG. 43 is an elevated top view of a high-speed marine vessel with an embodiment of the marine propulsion system of FIG. 1.
Figure 44:
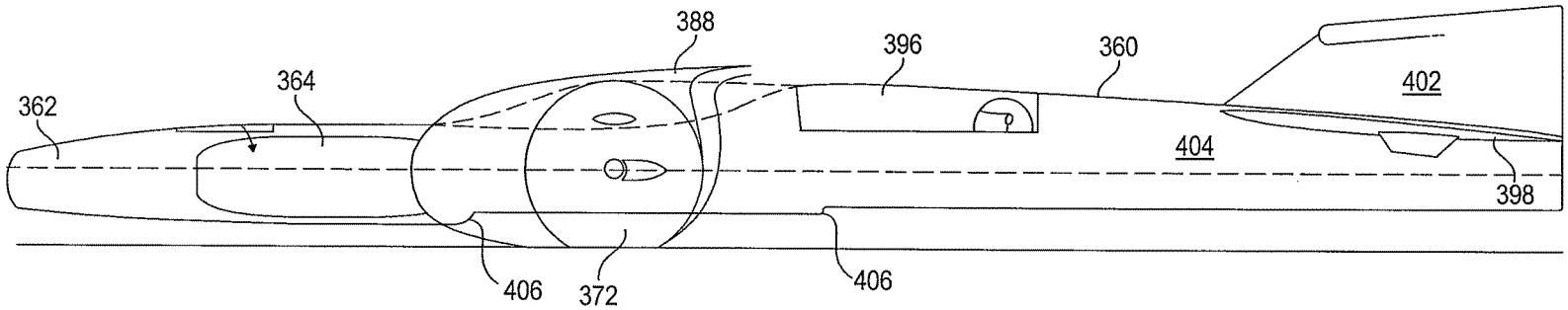
FIG. 44 is an elevated side view of the high-speed marine vessel of FIG. 43.

FIGS. 43 and 44 show a high-speed marine vessel 360 that includes many of the above-discussed aspects of the marine propulsion system and embodiments thereof, and may be suitable for a water speed record attempt. The high-speed marine vessel 360 has (from front to rear) an aerodynamic nose section 362, a motor 364, a transmission 366, a differential 368, left and right half-shafts 376, 374, left and right propulsion wheels 372, 370, left and right suspension members 384, 382, 380, 378, a pilot compartment 392 with a canopy 396, and a tail section 404. An air inlet 363 feeds air to the interior of the vessel, which air is used for engine intake, pilot breathing, component cooling and other uses. The pilot 394 sets in a reclined position in the pilot compartment 392, with the canopy 396 closed and secured. The tail section 404 has an elevator 398 and a runner 402 which are air-steering surfaces similar to those on an airplane, and are under control by the pilot 394 using controls and linkages readily devised. The left and right propulsion wheels 372, 370 have respective fairings 388, 386.

In operation, the motor 364 couples through the transmission 386, the differential 368, and the left and right half-shafts 376, 374 to the left and right propulsion wheels 372, 370. As the marine vessel 360 gains planing speed, the hull rises up on the steps 406. The suspension members, which can be part of an active suspension i.e. hydraulically and/or electronically controlled, regulate the propulsion wheels 372, 370 to maintain the preferred relationship of the propulsion wheels 372, 370 to the apparent water level, aided by the fairings 388, 386. With additional speed, the marine vessel 360 "flies" along across the surface of the water, with the air-steering surfaces maintaining the relationship of the hull just above the surface of the water and the scoops of the propulsion wheel 372, 370 continuing to dip into the water and create directed ejection flows of water. In this manner, hull friction with water and corresponding drag is greatly reduced or eliminated. In one embodiment, the air-steering surfaces are hydraulically and/or electronically controlled and are coordinated with an active suspension of the propulsion wheels 372, 370. Traction drive stability is achieved by having a front engine design, so that the motor 364 and the propulsion wheels 372, 370 are forward of the center of gravity 390 of the marine vessel 360. The air-steering surfaces are proportioned so that the center of pressure is aft of the center of gravity 390, as is the practice with rockets and stable airplanes. The placement of the engine and other masses forward of the center of gravity 390 aids in locating the center of gravity 390 forward of the center of pressure, thus employing the "arrow effect" for stability reasons. This achieves aerodynamic stability in the marine vessel 360. The combination of traction drive stability and aerodynamic stability is desired for this high-speed application, although further embodiments can trade off one type of stability for increases in the other.

The propulsion system may be adapted for use with amphibious vessels. For example, the water-channeling members may be adapted to allow travel along a beach or along the surface of ice. Alternatively, the propulsion wheel may be connected to rolling elements which are driven by the same rotary drive and which support the vessel upon exiting from the water. This rolling action will also accommodate passage over submerged objects such as ice and will have minimal detrimental effect on wildlife. The rotary drive that powers the rotation of the propulsion wheel may also power rolling elements that are linked through or separately from the propulsion wheel. For example, the rolling element may be a broad rim that is allowed to travel on a beach when the marine vessel exits the water.

For transition to land traction, the propulsion wheel could be fitted with individual shoes on each scoop. In a further embodiment, the propulsion system employs a continuous tread similar to a tank track, as will be described with reference to FIGS. 46 and 47. The propulsion wheel could be articulated downward and act directly on terrain as needed for temporary mobility. Beach "landing craft" and "ice field" applications are contemplated.

While the increased efficiency of the propulsion system relative to conventional systems provides advantages in high speed applications, recreational applications are also considered. For example, the rotary drive for powering the propulsion wheel may be manual, such as the use of a peddling system similar to a bicycle.

Figure 45:
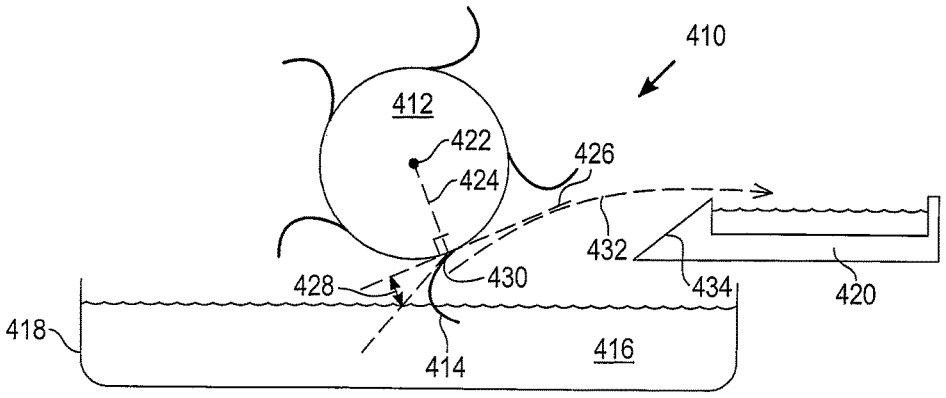
FIG. 45 is a schematic view of a water pump based upon the marine propulsion system of FIG. 1.

With reference to FIG. 45, a water pump 410 based on the marine propulsion system 10 is shown. A propulsion wheel 412 with a plurality of scoops 414 operates similarly to the marine propulsion system 10 as discussed above. However, the ejected water flow 432 is in this embodiment captured in a liquid catch-basin 420. The scoops 414 scoop water 416 or other liquid from a liquid supply basin 416 or other liquid supply source and direct the ejection water flow to the liquid catch-basin 420. The liquid catch-basin 420 is displaced from and mounted at an elevation above the liquid supply basin. The scoops 414 are mounted to a hub 422 and rotate about the hub 422. In order to aim the scoops, the water exit region 430 of the concave interior of each scoop is angled. Recall that, for horizontal water ejection the water exit region of the scoop is approximately horizontal at the mid-scooping position. Relative to the hub, the water exit region of the horizontally ejecting scoop is approximately perpendicular to a radius 424 of the scoop, i.e. the water exit region of the scoop is approximately parallel to a local tangent 426 of a rotation arc of the scoop about the hub. In order to pump the water to a higher elevation, the water exit region of the concave interior of the scoop is angled relative to this local tangent to the rotation arc of the scoop about the hub. This angle 428 of the water exit region of the scoop can be adjusted to achieve various trajectory angles of the ejected water flow 432. Other liquids besides water can be used. A pump that can move liquid from a liquid supply to a liquid catch-basin is thereby formed. This pump avoids losses arising from the viscosity and turbulence of a liquid within a pipe or hose. In the embodiment shown, the liquid catch-basin 420 has a sloping front section 434. This allows any stray liquid having sufficient forward momentum to travel onward and upward along the sloping front section 434 and into the liquid catch-basin 420.

Figure 46:
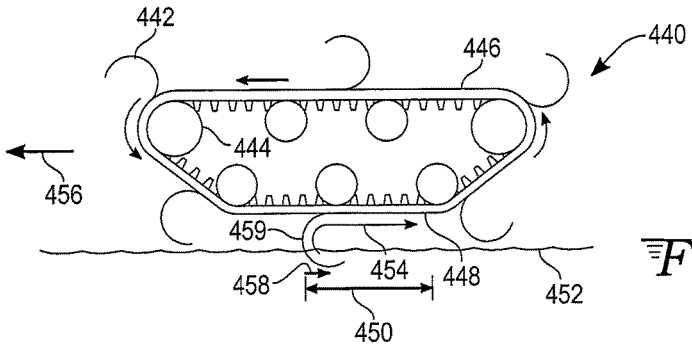
FIG. 46 is a schematic side view of an embodiment of the marine propulsion system of FIG. 1 showing a continuous track to which the scoops are mounted. The continuous track is similar to a tank tread.

With reference to FIG. 46, a marine propulsion system 440 is shown with a continuous track 446 that is similar to a tank tread or caterpillar track. Scoops 442 are mounted to the continuous track 446, with each scoop 442 attached to a respective portion of the continuous track 446. For example, the track can be a continuous band made of rubber or other flexible material, and can have reinforcing fibers or metal wires therein. As a further example, the track can be made of a series of metal, composite or high-strength plastic links joined by hinges, with each scoop attached to a respective link. The continuous track 446 travels about a series of hubs 444, which can include one or more bogie wheels, idler wheels, drive wheels, drive hubs or drive sprockets etc. as on a tank, half-track, snowmobile, or other tread-propelled or track-equipped vehicle. One or more of the hubs 444 drives the continuous track 446. As on such vehicles, the continuous track 446 runs in a straight line for a length 450 at the bottom of the travel path of the continuous track 446.

One advantage of such a system is that the overall height is reduced as compared to a propulsion wheel with similarly sized scoops. A further advantage is that, while scooping, each scoop travels essentially parallel to the local or apparent waterline along a length 450 while the portion 448 of the continuous track 446 is parallel to the local or apparent waterline 452, along the bottom of the travel path of the track. Such an arrangement allows for a longer distance for the scoop to travel while ejecting water, i.e. the length 450, and provides a straighter continuous path for water ejection 454 than does a propulsion wheel. A still further advantage of this embodiment is that the instantaneous direction of travel of the scoop is arranged to be parallel to the local or apparent waterline 452 over the entire length 450, rather than just at the mid-scooping position as with a propulsion wheel. With an exit-directing region of the scoop being approximately parallel to the instantaneous direction of travel 458 of the scoop 459, the scoop 459 can direct ejected water approximately parallel to the local or apparent waterline 452 over this entire length 450. This effectively provides the scoop with an extended mid-scooping position, lasting the entire length 450. By comparison, a scoop mounted to a propulsion wheel directs ejected water approximately parallel to the local or parent waterline primarily at the mid-scooping position, which is where maximum scooping depth is momentarily achieved. Thrust in a forward direction 456 derived from ejecting water in an opposed direction, in the embodiment shown in FIG. 46, thus occurs over a longer distance and for a greater proportion of the travel of the scoop about the hub as compared to a propulsion wheel. This results in an increase in thrust development efficiency for a specified rate of revolution of the scoops about the hub, as compared to a propulsion wheel. This increase in efficiency for thrust creation is offset by an increase in complexity and friction of the system in the continuous track embodiment, which acts to decrease efficiency.

Figure 47:
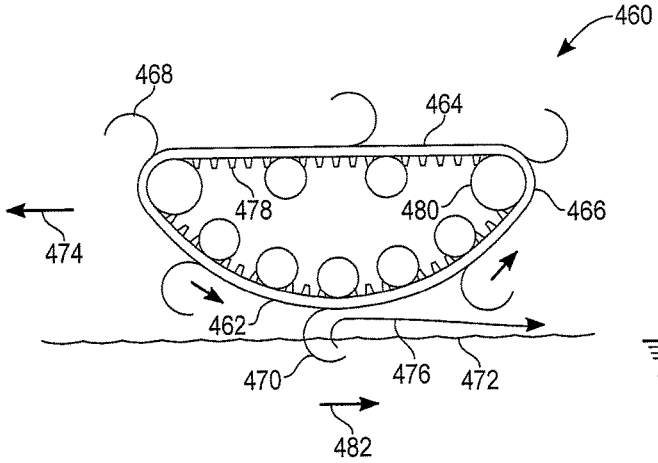
FIG. 47 is a schematic side view of an embodiment of the marine propulsion system of FIG. 1 having a variation of the continuous track of FIG. 46.

With reference to FIG. 47, a marine propulsion system 460 is shown, with a "D"-shaped path for a continuous track 466, to which track the scoops are mounted. Nubs 478, ridges, spikes or other protuberances on an inside surface of the continuous track 466 engage a drive sprocket, which can be included in one of the hubs 480 shown. The curved portion 462 of the travel path of the continuous track 466 faces convexly downward. Similarly to the embodiment shown in FIG. 46, a flat upper section 464 of the travel path of the continuous track 466 faces upward. Both of these embodiments, as shown in FIGS. 46 and 47 have lower profiles than do propulsion wheels with similarly sized scoops. The scoops 468 have a scooping action closely related to the scoops of a propulsion wheel as previously described, in that a scoop 470 at a mid-scooping position is also at a maximum scooping depth for that instant in time, and travels along a curved path into and out of the water. Unlike the propulsion wheel, yet similarly to the marine propulsion system 440 with a continuous track 446 shown in FIG. 46, the scoops 468 travel along a flat upper section 464 of the path of the continuous track 466. As with embodiments of the propulsion wheel, a scoop 470 at a mid-scooping position has an instantaneous direction of travel 482 of the scoop that is parallel to the local or apparent waterline 472, and the scoop can direct ejected water 476 approximately parallel to the local or apparent waterline 472 in order to develop thrust in a forward direction 474.

Figure 48:
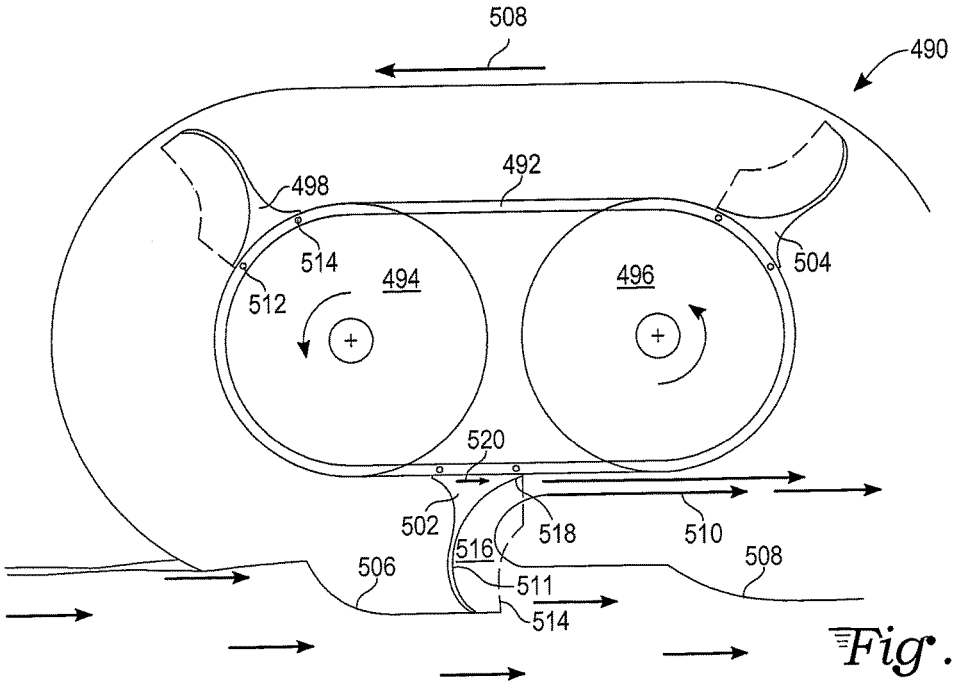
FIG. 48 is a schematic side view of an embodiment of the marine propulsion system of FIG. 1 having a further variation of the continuous track of FIG. 46.

With reference to FIG. 48, a marine propulsion system 490 is shown, with a continuous track 492 that cycles around two approximately equal sized hubs 494, 496. In this embodiment, three scoops 498, 502, 504 are attached to the continuous track 492. Each scoop is attached to the continuous track 492 by two pivoting members 512, 514 which allow the continuous track 492 to curve around each of the hubs 494, 496 and travel in a straight path between the hubs 494, 496. This embodiment uses the minimum number of hubs possible for a continuous track, as other continuous track embodiments use more than two hubs. Each scoop 502 is shown in cutaway form, with the centerline curvature 511 shown in solid line and the side and bottom outlines 514 in dashed line. The centerline curvature 511 of the scoop 502 redirects the scooped water 516 in the rearward direction. The exit-directing region 518 of the scoop 502 is approximately parallel to the instantaneous direction of travel 520 of the scoop 502 while the scoop is scooping water, and is positioned to direct the ejected water 510 horizontally in the rearward direction.

The scoop 502, having traveled around the forward hub 494, scoops redirects and ejects water in the rearward direction, digging a trench 506 in the water as it does so. The boat or other marine vessel to which the marine propulsion system 490 is attached is propelled in the forward direction 508, which displaces the trench 506 and a previously formed trench 508 in the rearward direction relative to the boat or vessel. The scoops 502, 504, 498 are arranged with sufficient spacing so that the ejected water 510 from one scoop 502 does not collide with another scoop 504, which is rotated by the rearward hub 496 up and out of the way of the ejected water 510. In the embodiment shown, the two hubs 494, 496 are spaced apart by less than a radius of one of the hubs, which provides sufficient spacing for three scoops 498, 502, 504. In further embodiments, other spacings between hubs and/or other numbers of scoops can be used.

What is claimed is:

1. A method for propulsion of a marine vessel situated in water, comprising:

dipping each of a plurality of water-directing scoops into the water;

moving each of the scoops in a rearward direction relative to the marine vessel while the scoop is dipping into the water;

scooping the water using a bottom edge and lower sides of each of the scoops;

directing the scooped water towards a centerline and a water exit region of each of the scoops; and ejecting substantially all of the directed scooped water in the rearward direction from the water exit region of the scoops at a scoop-relative exit velocity that is substantially greater than a scoop-relative entrance velocity at which the water was scooped, thereby producing a forward thrust on the marine vessel, with the water exit region of the scoop remaining above an apparent waterline while the water is scooped, directed and ejected, wherein at a mid-scooping position of the scooping, a given one of the scoops is positioned with respect to the apparent waterline such that less than half of a concave interior of the given scoop extends below the apparent waterline, wherein the scoops are shaped such that the directing concentrates water entering the given scoop from a bottom edge and lower sides of the given scoop along flow lines that flow upward and inward toward a top point of the centerline of the given scoop within the water exit region of the given scoop to form an accelerated jet of water, and the ejecting ejects substantially all of the water fully rearward or downward from the water exit region as the accelerated jet of water in a direction approximately parallel to or toward the apparent waterline, such that the accelerated jet of water is ejected at the scoop-relative exit velocity substantially greater than the scoop-relative entrance velocity.

2. The method of claim 1, further comprising adjusting the apparent waterline as presented to the plurality of water-directing scoops.

3. The method of claim 1, wherein the scoops are shaped to form a truncated hemisphere.

4. The method of claim 1, wherein the accelerated jet of water is ejected parallel to the apparent waterline.

5. A marine propulsion system comprising:

a hub; and a plurality of water-directing scoops arranged to rotate about the hub and that are connected thereto, each scoop having a smoothly rounded concave interior that is open-faced in a rearward direction when expressing a forward thrust of the propulsion system, a bottom edge distal to the hub, and an exit-directing region that is a portion of the concave interior, proximate to a top edge of the scoop, distal to the bottom edge of the scoop, and approximately parallel to an instantaneous direction of travel of the scoop, wherein a given one of the scoops at a mid-scooping position, and that is positioned with respect to an apparent waterline such that less than half of the concave interior of the given scoop extends below the apparent waterline, concentrates water entering the given scoop from a bottom edge and lower sides of the given scoop along flow lines that flow upward and inward toward a top point of the centerline of the given scoop within the water exit region of the given scoop to form an accelerated jet of water, and ejects substantially all of the water fully rearward or downward from the water exit region as the accelerated jet of water in a direction approximately parallel to or toward the apparent waterline, such that the accelerated jet of water is ejected at an exit velocity substantially greater than an entrance velocity at which the water ejected in the accelerated jet of water entered the given scoop.

6. The marine propulsion system of claim 5, wherein the instantaneous direction of travel of the given scoop is arranged to be parallel to a local or apparent waterline and the exit-directing region is arranged to be parallel to the local or apparent waterline.

7. The marine propulsion system of claim 5, wherein the exit-directing region of each scoop is approximately perpendicular to a radius from a center of the hub to the scoop.

8. The marine propulsion system of claim 5, wherein for each scoop the bottom edge of the scoop includes a truncated bottom edge.

9. The marine propulsion system of claim 5, wherein for each scoop a normal to the interior of the scoop sweeps a total angle of between about 90 degrees and about 180 degrees from the bottom edge to the interior region and the top edge of the scoop.

10. The marine propulsion system of claim 5, further comprising each scoop having a shape and orientation relative to the hub such that water being scooped by the bottom edge and a lower portion of the concave interior is redirected in the rearward direction and exits at the exit-directing region of the scoop, at an exit velocity relative to the scoop that is greater than an entrance velocity relative to the scoop and at an exit flow cross-section that is smaller than an entrance flow cross-section of the water being scooped.

11. The marine propulsion system of claim 5, wherein the concave interior has an ovoid shape.

12. The marine propulsion system of claim 5, wherein the concave interior has a truncated hemispherical shape.

13. The marine propulsion system of claim 5, wherein the concave interior has a forked shape, with tips of forked legs including the bottom edge distal to the hub.

14. The marine propulsion system of claim 5, wherein the bottom edge distal to the hub includes a floor or a web.

15. The marine propulsion system of claim 5, further comprising a portion of a hull of a marine vessel, or a tunnel or plate integratable with the hull, positioned relative to the hub and the scoops so as to adjust the apparent waterline presented to the scoops.

16. The marine propulsion system of claim 15, wherein the apparent waterline is adjusted to a level below the local waterline when the marine vessel is at speed.

17. The marine propulsion system of claim 5, wherein the scoops are rigidly connected to the rotatable hub.

18. The marine propulsion system of claim 5, wherein the scoops are mounted in a staggered formation about the hub.

19. The marine propulsion system of claim 5, further comprising:

one or more further hubs; and a continuous track arranged to travel about the rotatable hub and the one or more further hubs, with each scoop being attached to a respective portion of the continuous track, by which the continuous track connects the scoops to the rotatable hub.

20. The marine propulsion system of claim 19, wherein:

the rotatable hub and the one or more further hubs include at least one from the group consisting of bogie wheel, idler wheel, drive wheel, drive hub and drive sprocket; and the continuous track includes a member selected from the group consisting of a continuous band of flexible material reinforced with fibers or metal wires, and a plurality of links joined by hinges.

* * * * *